US007711308B2

(12) United States Patent
Hozumi et al.

(10) Patent No.: US 7,711,308 B2
(45) Date of Patent: May 4, 2010

(54) CLEANING DEVICE, PROCESS CARTRIDGE, AND IMAGE FORMING APPARATUS

(75) Inventors: Yoshiki Hozumi, Kanagawa (JP); Takeshi Saitoh, Tokyo (JP); Kazuhiko Watanabe, Tokyo (JP); Ken Amemiya, Tokyo (JP); Keiji Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 11/852,643

(22) Filed: Sep. 10, 2007

(65) Prior Publication Data

US 2008/0063448 A1 Mar. 13, 2008

(30) Foreign Application Priority Data

Sep. 11, 2006 (JP) ..... 2006-245040
Sep. 11, 2006 (JP) ..... 2006-245041
Jul. 13, 2007 (JP) ..... 2007-184258

(51) Int. Cl.
*G03G 21/00* (2006.01)
*G03G 21/16* (2006.01)
*B21B 45/02* (2006.01)

(52) U.S. Cl. ..... 399/351; 399/350; 399/343; 399/111; 15/256.51

(58) Field of Classification Search ..... 399/350, 399/351, 343, 111; 15/256.51
See application file for complete search history.

(56) References Cited

U.S. PATENT DOCUMENTS 4,576,468 A * 3/1986 Saito ..... 399/351
6,861,195 B2 * 3/2005 Oshiba et al. ..... 430/123.41
2006/0099016 A1 5/2006 Watanabe et al.
2006/0194662 A1 * 8/2006 Hozumi et al. ..... 474/111
2006/0285898 A1 12/2006 Watanabe et al.

FOREIGN PATENT DOCUMENTS

JP 60-198574 10/1985
JP 5-19671 1/1993
JP 6-214489 8/1994

(Continued)

OTHER PUBLICATIONS

U.S. Appl. No. 12/132,864, filed Jun. 4, 2008, Nakamura, et al.

(Continued)

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A blade of a cleaning device includes two surfaces: an upstream side surface and a downstream side surface. The two surfaces adjoin each other with respect to a contact edge of the blade. The upstream side surface has a longer dimension in the direction orthogonal to the contact edge than that of the downstream side surface. A horizontal portion of a blade holder that restricts a warp in the blade is bonded on an opposed surface to the upstream side surface of the blade. The blade is held via the horizontal portion with a vertical portion of the blade holder supported by the main body of the cleaning device in a downstream of a normal line to a contact point on a photoconductor surface in contact with the contact edge, in the photoconductor-surface moving direction.

15 Claims, 12 Drawing Sheets

FOREIGN PATENT DOCUMENTS

| | | |
|---|---|---|
| JP | 9-325659 | 12/1997 |
| JP | 2001-312191 | 11/2001 |
| JP | 2003-186362 | 7/2003 |
| JP | 2004-272019 | 9/2004 |
| JP | 2005-10576 | 1/2005 |
| JP | 2005-173305 | 6/2005 |
| JP | 2005-321735 | 11/2005 |
| JP | 2006-11375 | 1/2006 |
| JP | 2006-154747 | 6/2006 |

OTHER PUBLICATIONS

U.S. Appl. No. 12/266,877, filed Nov. 7, 2008, Watanabe, et al.

* cited by examiner

CLEANING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document, 2006-245040 filed in Japan on Sep. 11, 2006, Japanese priority document, 2006-245041 filed in Japan on Sep. 11, 2006 and Japanese priority document, 2007-184258 filed in Japan on Jul. 13, 2007.

BACKGROUND OF THE INVENTION

1. Field of the Invention

The present invention relates to a cleaning device for use in an image forming apparatus.

2. Description of the Related Art

Various types of image forming apparatuses, such as electrophotographic types and ink-jet types, are conventionally known. Such image forming apparatuses generally include surface moving members. For example, some electrophotographic image forming apparatuses include surface moving members, such as a latent-image bearing member (an image bearing member), e.g. a photoconductor drum, an intermediate transfer medium (an image bearing member), e.g. an intermediate transfer belt, and a recording material conveyor member, e.g. a paper conveyor belt. Furthermore, some ink-jet image forming apparatuses include surface moving members, such as a recording material conveyor member, e.g. a paper conveyor belt. Generally, unwanted deposit, e.g. toner, may be attached onto a surface of such surface moving member during a use of such image forming apparatuses, thereby causing various problems. Therefore, a cleaning unit that removes the unwanted deposit from the surface of a surface moving member is required. As such cleaning unit, a blade is widely used because preferable performance of removing deposit can be achieved with a simple configuration of the blade. Specifically, such blade removes a deposit by squeezing a cleaning blade made of an elastic material, e.g., polyurethane rubber, onto the surface of a surface moving member.

For a cleaning device having such a blade, two types are known, i.e., a trailing type and a counter type. Respective cleaning devices of the two types are explained below with examples of a cleaning device for a photoconductor in an electrographic image forming apparatus.

FIG. 17A is a schematic diagram for explaining a conventional cleaning device of a trailing type. The conventional cleaning device shown in FIG. 17A includes a photoconductor (surface moving member) 10 and a cleaning blade 231. The photoconductor 10 has a drum shape. The cleaning blade 231 is made of a long elastic material extending along the direction of a photoconductor rotation axis orthogonal to a surface moving direction A of the photoconductor 10. The conventional cleaning device is configured in such a manner that a longitudinally extending edge of the cleaning blade 231 (hereinafter, "contact edge") is to be pressed on the surface of the photoconductor 10. In the trailing type, the cleaning blade 231 is held with a blade holder (holding member) 232 supported upstream of a normal line N in the photoconductor-surface moving direction by the main body of the cleaning device, where the normal line N is normal to a contact point P on the photoconductor surface in contact with the contact edge of the cleaning blade 231. The trailing type means a configuration in which the holding member holds the elastic member; the supporting unit supports the holding member against the main body of the cleaning device; and the supporting unit is arranged upstream of a normal line in the surface moving direction of the surface moving member, where the normal line is normal to a contact point on the surface of the surface moving member in contact with the contact edge of the elastic member.

FIG. 17B is a schematic diagram for explaining a conventional cleaning device of a counter type. The conventional cleaning device shown in FIG. 17B is configured in such a manner, similar to that shown in FIG. 17A, that the cleaning blade 231 made of a long elastic material extends along the direction of the photoconductor rotation axis orthogonal to the surface moving direction A of the photoconductor 10, and a longitudinally extending contact edge of the cleaning blade 231 is to be pressed on the surface of the photoconductor 10. In the counter type, the cleaning blade 231 is held with the blade holder 232 supported downstream of the normal line N in the photoconductor-surface moving direction by the main body of the cleaning device, the normal line N being normal to the contact point P in contact with the contact edge of the cleaning blade 231. The counter type means a configuration in which the holding member holds the elastic member; the supporting unit supports the holding member against the main body of the cleaning device; and the supporting unit is arranged downstream of the normal line in the surface moving direction of the surface moving member, where the normal line is normal to the contact point on the surface of the surface moving member in contact with the contact edge of the elastic member.

In both, the trailing type and the counter type, if a friction force between the cleaning blade 231 and the photoconductor surface changes due to some reasons while the photoconductor 10 is rotating in operation, flapping (loose movement) of the cleaning blade 231 occurs, consequently causing a problem, such as damage to the photoconductor 10, or abnormal noise. In the trailing type, flapping occurs less often than in the counter type, and even if flapping occurs, it causes few problems. The reason for this is because when the friction force between the cleaning blade 231 and the photoconductor surface increases while the photoconductor 10 is rotating in operation, the cleaning blade 231 of the trailing type can warp towards a direction to release a vertical resistance of the cleaning blade 231; in contrast, the cleaning blade 231 of the counter type cannot warp towards the direction to release the vertical resistance. Moreover, in the counter type, the cleaning blade 231 cannot warp towards the direction to release the vertical resistance, and when the friction force between the cleaning blade 231 and the photoconductor surface increases, a serious problem, i.e., a blade turnup, may occur.

On the other hand, in the counter type, a contact pressure can be increased to be higher than that in the trailing type, so that a removal performance by the counter type is higher than that by the trailing type.

More specifically, in the case of the trailing type, if the cleaning blade 231 is pressed with a large force to increase the contact pressure, the cleaning blade 231 warps, thus causing a redundant touch, in which an upstream side surface 231*a* of the cleaning blade 231 touches on the photoconductor surface. In this case, the upstream side surface 231*a* is a surface of the cleaning blade 231 positioned upstream of the contact edge in the photoconductor-surface moving direction. If the redundant touch occurs, a contact area between the cleaning blade 231 and the photoconductor surface suddenly increases. As a result, the contact pressure is inversely decreased despite pressing the cleaning blade 231 with a large force, thus degrading the removal performance. By contrast, in the case of the counter type, even if pressing the cleaning blade 231 with a large force to increase the contact pressure, a friction force works against a warp in the cleaning blade, so that the cleaning blade 231 warps little. Accordingly, a redundant touch less easily occurs even if pressing the cleaning blade 231 with a large force, and a large pressing force can be applied onto a small contact area. Thus, a high contact pressure can be achieved, and a preferable removal performance can be achieved.

Japanese Patent Application Laid-Open No. S60-198574 discloses (see FIG. 8) a cleaning device of the trailing type that cleans a photoconductor. The cleaning device includes a backup member that supports, from the back surface, a force received by the tip of the cleaning blade due to rotation of the photoconductor.

It is appropriately determined whether to use the trailing type or the counter type based on consideration of respective advantages and respective disadvantages. If a high removal performance is required, it is preferable to employ the counter type because of high performance efficiency described above. Specifically, a recent electrophotographic image forming apparatuses often uses a toner of which particles are spherical and have a small diameter, particularly, a polymerized toner, so that an excellent removal performance is required to remove such toner. Thus, a cleaning device of the counter type tends to be employed in many cases, because its removal performance is preferable while the removal performance by a cleaning device of the trailing type is insufficient.

However, the conventional counter type cleaning device has a problem that life durations of the photoconductor and the cleaning blade are shortened, because the cleaning blade is excessively pressed with a large force to increase the contact pressure for obtaining a preferable removal performance. As a result, the photoconductor (surface moving member) to be cleaned and the cleaning blade are excessively worn.

On the other hand, the cleaning device disclosed in the above document No. S60-198574 can achieve a higher contact pressure than that by a general trailing type as shown in FIG. 17A. However, to achieve a contact pressure in the cleaning device as high as that in the counter type, a backup member and a mechanism to support the backup member needs to be reinforced to press down a warp in the cleaning blade. To achieve a similar contact pressure, a simpler configuration and a lower cost can be realized in a cleaning device of the counter type than those in the cleaning device disclosed in the above document No. S60-198574.

Because the counter type can provide a higher contact pressure than the trailing type, the counter type has an advantage of a higher removal performance than the trailing type, and is widely used, as disclosed in Japanese Patent Application Laid-Open No. 2001-312191.

To explain in detail, in the case of the trailing type, if pressing the cleaning blade 231 with a large force to provide a high contact pressure, the cleaning blade 231 warps, and a redundant touch occurs so that the upstream side surface 231*a* touches on the photoconductor surface. If the redundant touch occurs, a contact area between the cleaning blade 231 and the photoconductor surface suddenly increases. As a result, the contact pressure is inversely decreased despite pressing the cleaning blade 231 with a large force, thus degrading the removal performance. By contrast, in the case of the counter type, even if pressing the cleaning blade 231 with a large force to provide a high contact pressure, a friction force works against a warp in the cleaning blade, so that the cleaning blade 231 warps little. Accordingly, a redundant touch less easily occurs even if pressing the cleaning blade 231 with a large force, and a large pressing force can be applied onto a small contact area. Thus, a high contact pressure can be achieved, and an excellent removal performance can be obtained.

However, when the friction force between the cleaning blade 231 and the photoconductor surface increases while the photoconductor 10 is rotating in operation, the cleaning blade 231 of the trailing type can warp towards a direction to release a vertical resistance of the cleaning blade 231; in contrast, the cleaning blade 231 of the counter type cannot warp towards the direction to release the vertical resistance. Consequently, when the friction force between the cleaning blade 231 and the photoconductor surface increases, a serious problem may occur, e.g., a blade turnup, or an excess load applied on operation of the photoconductor.

Specifically, a recent electrophotographic image forming apparatuses often uses a toner of which particles are spherical and have a small diameter, particularly, a polymerized toner, so that an excellent removal performance is required to remove such toner. Therefore, a sufficient removal performance needs to be ensured, by employing a cleaning device of the counter type, and setting the contact pressure of the cleaning blade as high as possible. Under such situation, a problem easily occurs, such as a blade turnup or an excess load on operation of the photoconductor, because the maximum value of a friction force arising from fluctuation in the friction force between the cleaning blade and the photoconductor surface changes while the photoconductor is rotating in operation.

SUMMARY OF THE INVENTION

It is an object of the present invention to at least partially solve the problems in the conventional technology.

According to an aspect of the present invention, there is provided a cleaning device that removes deposit on a surface of a surface moving member and includes an elastic member configured to be pressed onto the surface of the surface moving member with a longitudinal edge of the elastic member to apply a first force in a normal line direction at a contact point on the surface of the surface moving member, thereby removing deposit from the surface of the surface moving member, wherein the longitudinal edge is extended along a longitudinal direction of the elastic member, the longitudinal direction orthogonal to a surface moving direction of the surface moving member, is in contact with the surface moving member at a contact point on the surface of the surface moving member, and receives a second force towards downstream in the surface moving direction from the surface of the surface moving member when the surface of the surface moving member moves, and surfaces of the elastic member includes a first surface, a second surface, and a third surface, wherein the first surface and the second surface adjoin each other with respect to the longitudinal edge, the first surface being positioned upstream of the longitudinal edge in the surface moving direction, and the second surface being positioned downstream of the longitudinal edge in the surface moving direction, and the third surface is positioned on an opposite side of the first surface on the elastic member; a warp restrictive member that restricts a warp in the elastic member, the warp being formed in a manner that the first surface expands and the third surface shrinks; and a holding member that supports the elastic member, and is supported by a main body of the cleaning device in a downstream side in the surface moving direction with respect to a normal line to the contact point, wherein the elastic member is formed to have a first thickness thicker than a second thickness, the first thickness being a dimension in a direction orthogonal to both the longitudinal direction and a direction of the second force, and the second thickness being a dimension in a direction substantially parallel to the direction of the second force, the warp restrictive member is arranged on the third surface, and the holding member holds the elastic member via the warp restrictive member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 2:
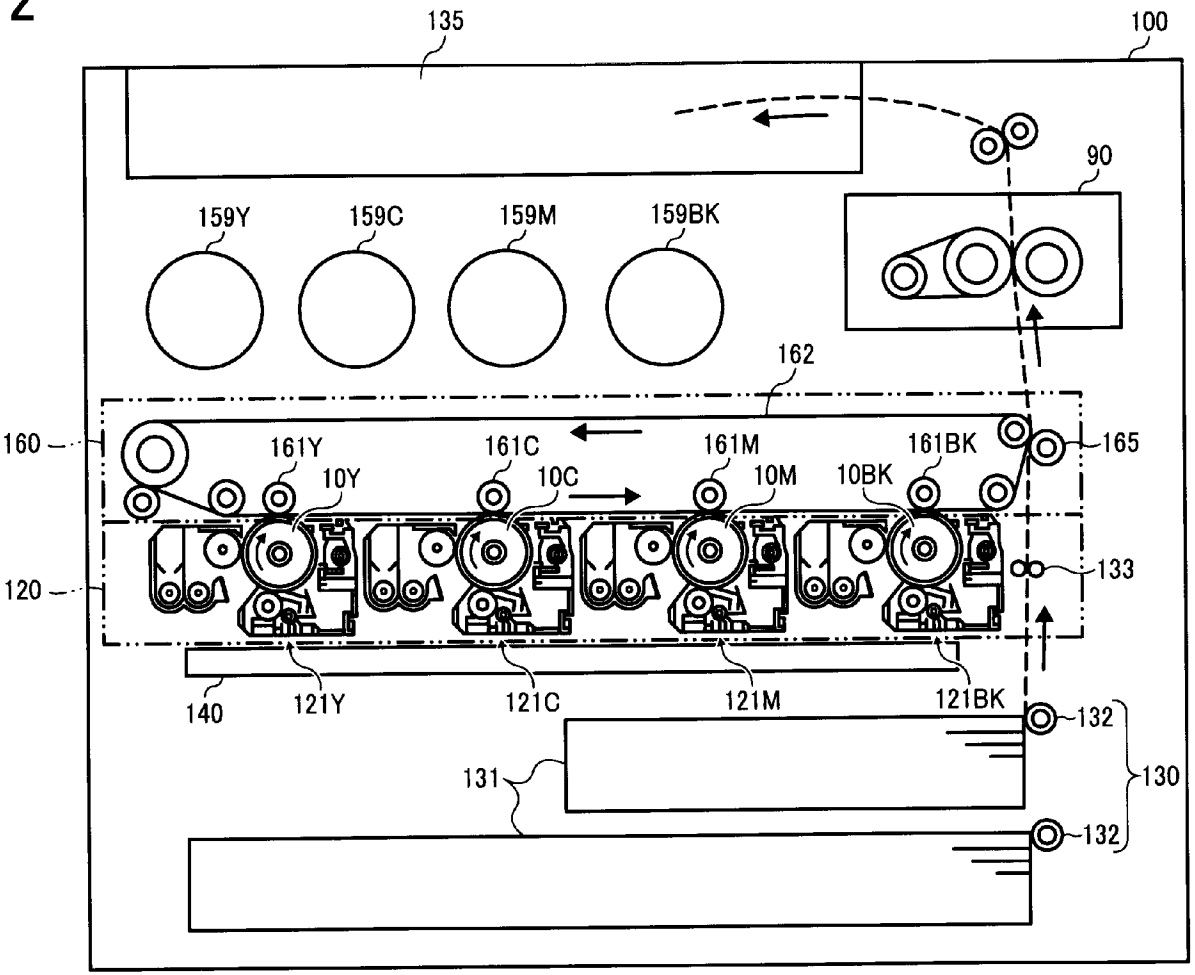
FIG. 2 is a schematic diagram for explaining an outline configuration of the printer according to the first embodiment.

FIG. 2 is a schematic diagram of an outline configuration of a printer according to a first embodiment of the present invention.

A printer 100 is to form a full color image, and includes an image forming unit 120 and a paper feeding unit 130. Hereinafter, characters Y, C, M, and Bk are attached to respective members to indicate that each of the members is for yellow, cyan, magenta or black.

In the image forming unit 120, from the left of FIG. 2, a process cartridge 121Y for a yellow toner, a process cartridge 121C for a cyan toner, a process cartridge 121M for a magenta toner, and a process cartridge 121Bk for a black toner are provided in order. The process cartridges 121Y, 121C, 121M, and 121Bk are aligned and arranged along a substantially horizontal direction.

A secondary transfer device 160 includes an intermediate transfer belt 162, primary transfer rollers 161Y, 161C, 161M, and 161Bk, and a secondary transfer roller 165. The intermediate transfer belt 162 is an endless intermediate transfer medium, which covers across a plurality of supporting rollers. The intermediate transfer belt 162 is arranged along a surface moving direction of photoconductors 10Y, 10C, 10M, and 10Bk. The photoconductors 10Y, 10C, 10M, and 10Bk are latent-image bearing members in a drum shape, which are image bearing members as surface moving members, provided for the process cartridges 121Y, 121C, 121M, and 121Bk, respectively, above the respective process cartridges. The surface movement of the intermediate transfer belt 162 is synchronized with the surface movement of the photoconductors 10Y, 10C, 10M, and 10Bk. The primary transfer rollers 161Y, 161C, 161M, and 161Bk are arranged on the inner surface of the intermediate transfer belt 162. The outer surface positioned underneath the intermediate transfer belt 162 is in contact with the outer surfaces of the photoconductors 10Y, 10C, 10M, and 10Bk under low pressure applied by the primary transfer roller.

Configurations and operations to form respective toner images on the photoconductors 10Y, 10C, 10M, and 10Bk and to transfer the toner images onto the intermediate transfer belt 162 are substantially identical with one another in relation to the process cartridges 121Y, 121C, 121M, and 121Bk. However, each of the primary transfer rollers 161Y, 161M, and 161M corresponding to each of the three of the process cartridges 121Y, 121C, and 121M for color is equipped with a swing mechanism (not shown) to swing the process cartridge. The swing mechanism works not to allow the intermediate transfer belt 162 to contact the photoconductors 10Y, 10C, and 10M when forming a monochrome image by the photoconductor 10Bk.

The secondary transfer device 160 is configured to be demountable from the main body of the printer 100. Specifically, a front cover (not shown) in front of paper in FIG. 2 that covers the image forming unit 120 can be opened, the secondary transfer device 160 can be sided from back of the paper in FIG. 2 to the front side, so that the secondary transfer device 160 can be demounted from the printer 100. When mounting the secondary transfer device 160 into the printer 100, a reverse process of the demounting process.

A cleaning device for removing deposit, such as residual toner after a secondary transfer, can be provided downstream of the secondary transfer roller 165 and upstream of the process cartridge 121Y in the surface moving direction on the intermediate transfer belt 162. In this case, the cleaning device can employ the same configuration as the cleaning device for a photoconductor, which will be described later. The cleaning device is preferably provided at the secondary transfer device 160 in such a position that the cleaning device is supported together with the intermediate transfer belt 162.

Toner cartridges 159Y, 159C, 159M, and 159Bk respectively corresponding to the process cartridges 121Y, 121C, 121M, and 121Bk are aligned and arranged in a substantially horizontal direction above the secondary transfer device 160.

An exposure device 140 that forms an electrostatic latent image by irradiating a laser beam onto the surfaces of the photoconductors 10Y, 10C, 10M, and 10Bk that is electrostatically charged below the process cartridges 121Y, 121C, 121M, and 121Bk.

Furthermore, the paper feeding unit 130 is arranged below the exposure device 140. The paper feeding unit 130 includes paper feeding cassettes 131 and paper feeding rollers 132, which accommodate transfer paper as a recording material, and feed the transfer paper via a pair of register rollers 133 towards a secondary transfer nip between the intermediate transfer belt 162 and the secondary transfer roller 165 with certain timing.

A fixing device 90 is arranged on the delivery side of the secondary transfer nip. An ejected-paper container unit 135 that accommodates paper ejecting rollers and ejected transfer paper is arranged downstream of the fixing device 90 in the transfer-paper carrying direction.

Figure 3:
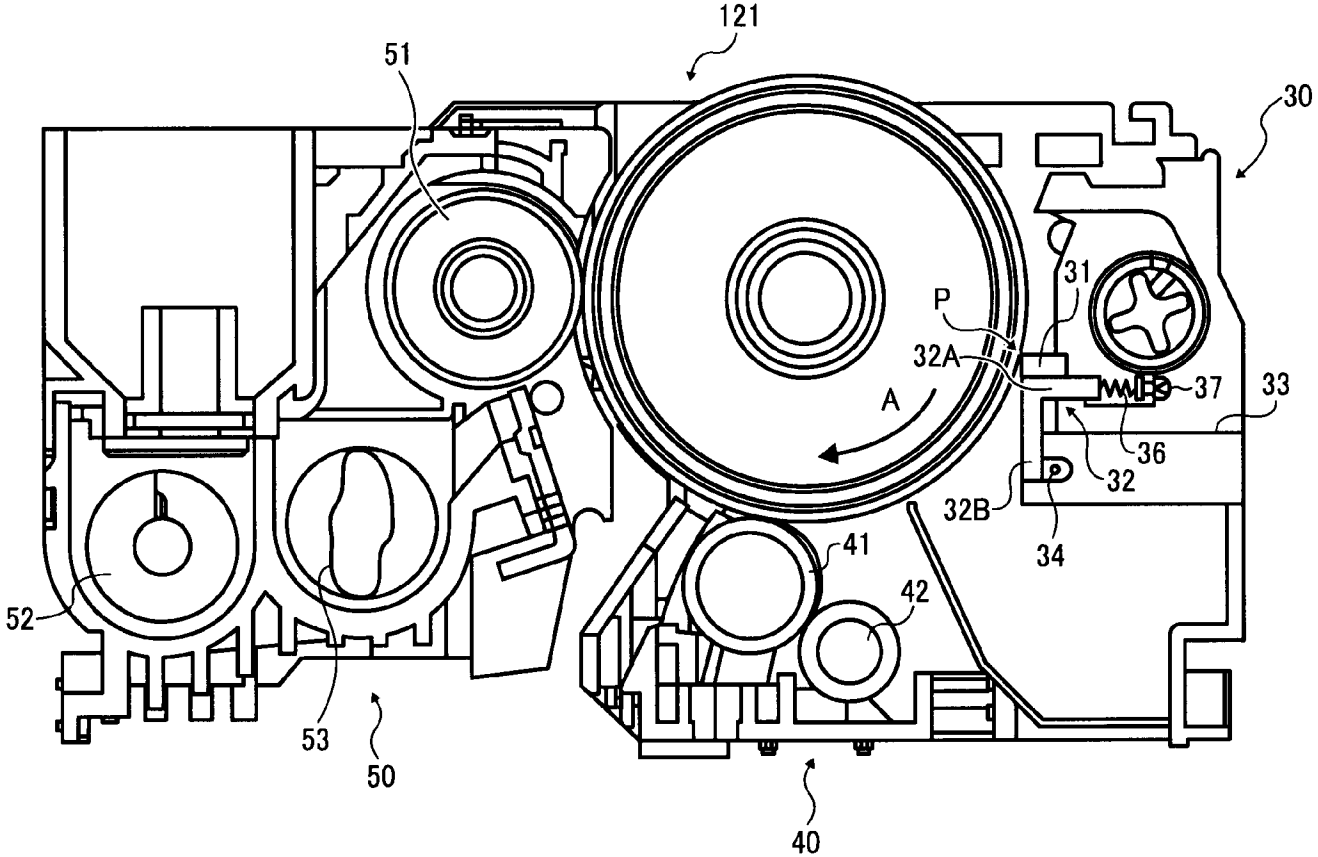
FIG. 3 is a schematic diagram for explaining an outline configuration of a process cartridge to be provided in the printer shown in FIG. 2.

FIG. 3 is a schematic diagram of an outline configuration of a process cartridge to be provided in the printer 100.

Configurations of the process cartridges are substantially similar to each other, so that a configuration and an operation of one of the process cartridges is explained in the following explanation without attached characters Y, C, M, and Bk for distinguishing between the process cartridges in terms of color.

The process cartridge 121 includes the photoconductor 10, and a cleaning device 30, an electric charger 40, and a developing device 50, three of which are arranged around the photoconductor 10.

The cleaning device 30 includes a cleaning blade (hereinafter, "blade") 31 that is an elastic member used longitudinally extending along the rotational axis direction of the photoconductor 10. The cleaning device 30 removes unwanted deposit, such as transfer residual toner on a photoconductor surface, by pressing a longitudinally extending edge (contact edge) of the blade 31 onto the surface of the photoconductor 10. According to the first embodiment, polyurethane rubber is used as a material of the blade 31, because polyurethane rubber has more excellent characteristics for wear properties of the photoconductor 10 and in wear resistance of the blade 31 itself than other elastic materials. The cleaning device 30 will be explained in detail later.

A lubricant applicator can be provided in the cleaning device 30. As the lubricant applicator, a device that includes a solid lubricant, a lubricant supporting member for supporting the solid lubricant, and a brush roller for applying the lubricant by rotating in contact with both the solid lubricant and the photoconductor 10, can be used. Such lubricant applicator applies powdery lubricant with the brush roller scraped by the brush roller from the solid lubricant onto the surface of the photoconductor 10. Alternatively, an applying blade can be arranged downstream of the brush roller in the photoconductor-surface moving direction to be in contact with the surface of the photoconductor 10. The applying blade is supported by an applying blade holder by keeping the tip of the applying holder in contact with the surface of the photoconductor 10, for making uniform the thickness of lubricant applied on the photoconductor 10.

The electric charger 40 includes a charging roller 41 that is arranged to come in contact with the photoconductor 10, and a charging roller cleaner 42 that rotates in contact with the charging roller 41.

The developing device 50 is configured to produce a visible image from an electrostatic latent image by feeding toner onto the surface of the photoconductor 10, and includes a developing roller 51, a stirring screw 52, and a feeding screw 53. The developing roller 51 is a developer bearing member that bears a developer on its surface. The stirring screw 52 stirs a developer contained in a developer container unit. The feeding screw 53 feeds the stirred developer onto the developing roller 51.

Each of the four of the process cartridges 121 configured as described above can be individually demounted and replaced by a service person or a user. In the process cartridge 121 demounted from the printer 100, any of the photoconductor 10, the electric charger 40, the developing device 50, and the cleaning device 30 can be individually replaced with a new one. The process cartridge 121 can include a used toner tank that collects transfer residual toner collected by the cleaning device 30. In such case, if the process cartridge 121 includes the used toner tank in a configuration in which the used toner tank can be individually demounted and replaced, the convenience is enhanced.

Operations of the printer 100 are explained below.

Upon receiving a command to print, the photoconductor 10 is rotated in the direction of an arrow A shown in FIG. 3, and the surface of the photoconductor 10 is uniformly charged with a certain polarity by the charging roller 41 of the electric charger 40. The exposure device 140 irradiates a modulated light that is modulated correspondingly to receive color image data, e.g., a laser beam for each color, onto the photoconductor 10 after charged. Accordingly, an electrostatic latent image of each color is formed on the surface of the photoconductor 10. The developing roller 51 of the developing device 50 feeds each color developer for the electrostatic latent image, develops the electrostatic latent image in each color with the color developer, forms a toner image corresponding to each color, and produce a visible image. A transfer electric field is then formed by applying a transfer voltage of the reversed polarity to the toner image onto a primary transfer roller 161, and the primary transfer roller 161 presses the intermediate transfer belt 162 at low pressure and comes in contact, so that a primary transfer nip is formed. According to the operations, the toner image formed on each of the photoconductors 10 is efficiently transferred primarily onto the intermediate transfer belt 162. On the intermediate transfer belt 162, the toner images of the respective colors formed by the respective photoconductors 10 are transferred in a superposed manner, so that a multilayered toner image is formed.

Transfer paper stocked in the paper feeding cassette 131 is fed via the paper feeding roller 132 and the pair of register rollers 133 with a certain timing, and a transfer electric field is generated on the secondary transfer roller 165 by applying a transfer voltage of the reversed polarity to the multilayered toner image, so that the multilayered toner image is transferred onto the transfer paper. The multilayered toner image secondarily transferred onto the transfer paper is sent to the fixing device 90, and fixed by the fixing device 90 with heat and pressure. The fixed transfer paper is ejected by the paper ejecting rollers to the ejected-paper container unit 135, and placed therein. On the other hand, transfer residual toners, which has been left on the photoconductors 10 after the first transfer, are scraped off and removed by the blade 31 of the cleaning device 30.

Figure 1:
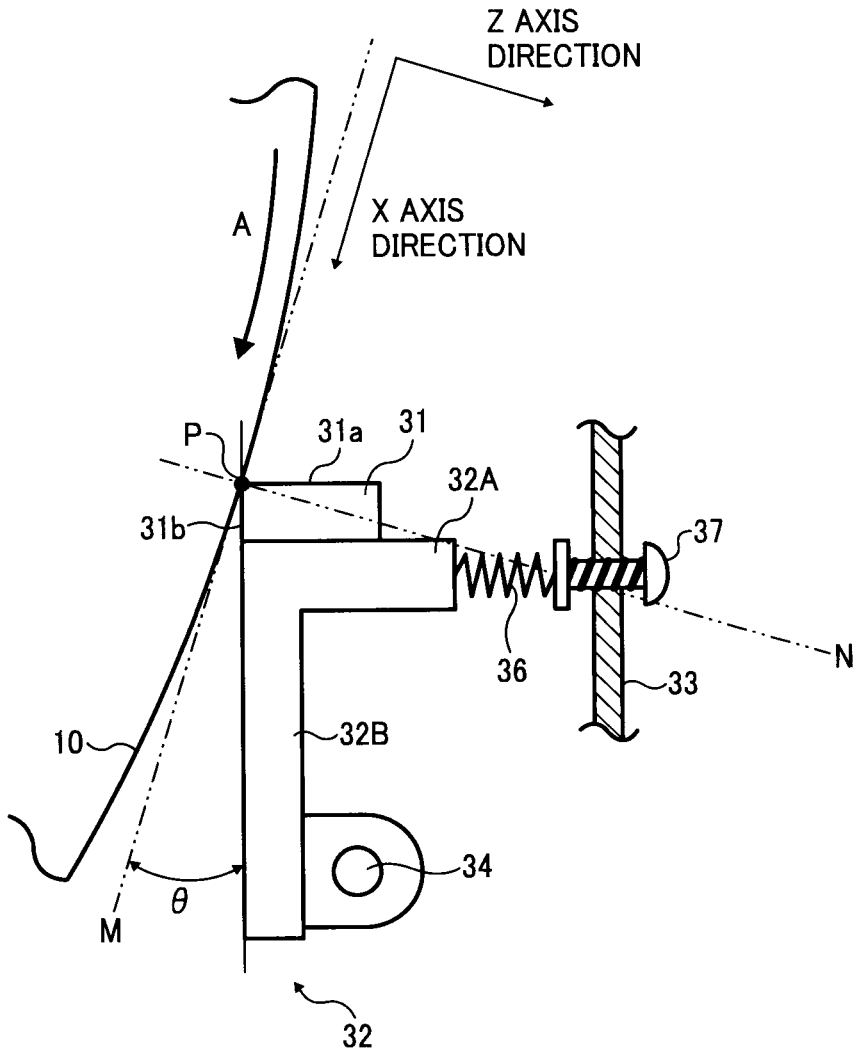
FIG. 1 is a schematic diagram for explaining relevant parts of a cleaning device for a printer, viewed from a photoconductor rotation axis direction, according to a first embodiment of the present invention.

FIG. 1 is a schematic diagram for explaining relevant parts of the cleaning device 30, viewed from the rotation axis direction of the photoconductor 10 (y axis direction).

Figure 4:
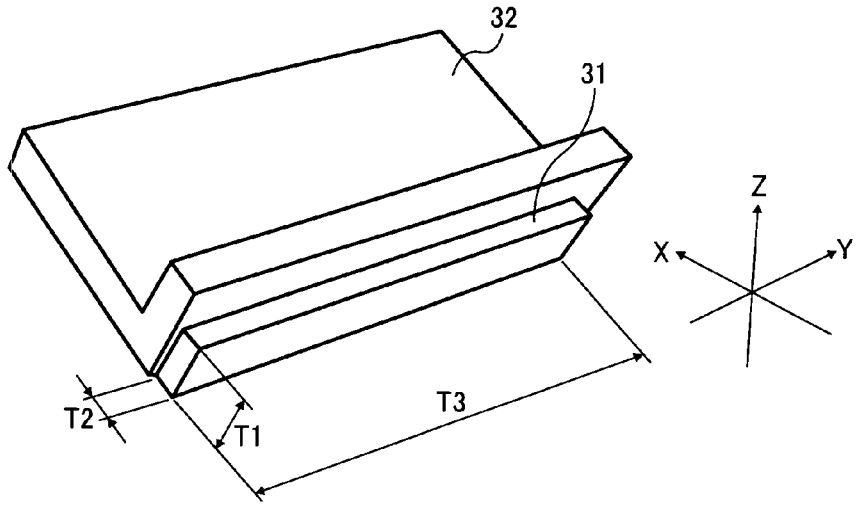
FIG. 4 is a perspective view of relevant parts of the cleaning device shown in FIG. 1.

FIG. 4 is a perspective view of relevant parts of the cleaning device 30.

In the first embodiment, the cleaning device 30 includes a blade holder 32 that holds the blade 31, and is made of a rigid material. The blade holder 32 has a substantially L-shaped cross section that is cut orthogonally to the rotation axis of the photoconductor 10. The blade 31 is bonded on the upper surface of a horizontal portion 32A of the blade holder 32, where the horizontal portion 32A is a portion extending along a substantially horizontal direction in FIG. 3, and the upper surface is a surface facing upstream in the photoconductor-surface moving direction. A method of bonding can be adhesive bonding, hot melt, or the like. According to the first embodiment, the horizontal portion 32A functions as a warp restrictive member to restrict a warp in the blade 3.

The blade holder 32 includes a vertical portion 32B, which vertically extends in FIG. 3. A bottom end (extremity downstream in the photoconductor-surface moving direction) of the vertical portion 32B is pivotably supported by a shaft 34, which is provided on a frame 33 of the cleaning device 30. According to the first embodiment, the horizontal portion 32A, on which the blade 31 is bonded, is held with the vertical portion 32B of the blade holder 32, which is supported downstream of a normal line N in the photoconductor-surface moving direction by the shaft 34 on the frame 33 of the cleaning device 30, i.e., supported by the main body of the cleaning device 30, where the normal line N is normal to a contact point P on the surface of the photoconductor 10 in contact with the contact edge of the blade 31. In other words, the cleaning device 30 is a counter type, and the vertical portion 32B of the blade holder 32 functions as a holding member.

In addition, the cleaning device 30 includes springs 36 as a force assistance unit, which enhances a pressing force applied by the blade 31 in the direction of the normal line N to the contact point P on the surface of the photoconductor 10. According to the first embodiment, two of the springs 36 are provided, each of which is arranged at a distance of 110 millimeters from the center in the longitudinal direction of the blade 31 (the photoconductor rotation-axis direction) towards a longitudinal end. An end of the spring 36 is connected to an end of the horizontal portion 32A, and the other end of the spring 36 is connected to an adjustive screw 37, which is an assistance-force adjustment unit. The adjustive screw 37 is engaged in a screw hole arranged in the frame 33 of the cleaning device 30. When adjusting the pressing force by using the adjustive screw 37, an adjusting stick is inserted through a notched hole from the outside of the frame 33 of the cleaning device 30, and the length of the spring 36 is adjusted by turning the adjustive screw 37 with the adjusting stick.

Adjustment of the pressing force of the blade 31 to the surface of the photoconductor 10 is explained below.

Figure 5:
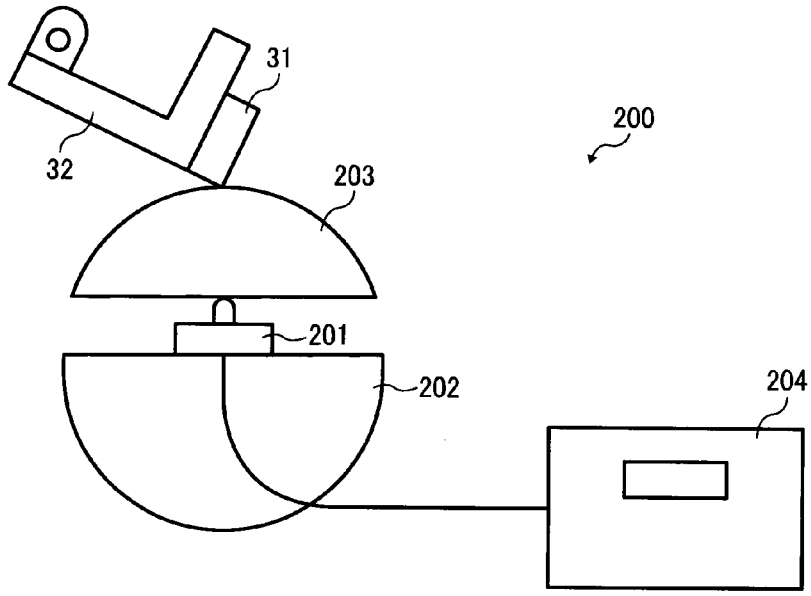
FIG. 5 is a schematic diagram for explaining a measuring device for a pressing force of a blade to be provided in the cleaning device shown in FIG. 4.

FIG. 5 is a schematic diagram for explaining a measuring device 200 for a pressing force of the blade 31. In practice, the measuring device 200 can be a commercially available conditioner for sensor, WGA-710B (manufactured by KYOWA DENGYO Co., Ltd.), and a load cell, LMA-A-20N (manufactured by KYOWA DENGYO Co., Ltd.), which can be used in combination with the conditioner. The measuring device 200 includes three of load cells 201. The load cells 201 are fastened on a cell mount 202, which is in a semicylindrical shape, at three points in total: one is at the center in the longitudinal direction of the blade 31; and the other two in a distance of 140 millimeters from the center towards respective longitudinal ends. Jigs 203 are placed on the load cells 201. The jigs 203 have a curved surface having the same curvature radius as the photoconductor 10. The jigs 203 are arranged three in line along the longitudinal direction of the blade 31, each of the load cells 201 is set at the center of the bottom surface of each of the jigs 203.

The blade 31 is set on the measuring device 200 such that a positional relation with the jigs 203 is to be the same as that with the photoconductor 10.

When adjusting the pressing force of the blade 31 by using the measuring device 200, the measuring device 200, instead of the photoconductor 10, is mounted onto the process cartridge 121 in a state where the cleaning device 30 is assembled in the printer 100. Specifically, by using a supporting unit to support a driving shaft of the photoconductor 10, the cell mount 202 on which three of the load cells 201 are fastened, and three of the jigs 203 are mounted on the process cartridge 121. When mounting, the cell mount 202 and the jigs 203 are set in such a manner that a virtual line between the contact edge of the blade 31 and each of the load cells 201 is to become perpendicular to the bottom surface of each of the jigs 203. A load applied via each of the jigs 203 is then detected by each of the load cells 201, and the pressing force of the blade 31 is adjusted by regulating the adjustive screw 37, while watching a value displayed on a sensor conditioner 204 connected to the measuring device 200.

When measuring, a predetermined weight needs to be placed on each of the jigs 203 in advance, and the adjustive screws 37 has to be set such that each value displayed on the sensor conditioner 204 is to be the same, and the value displayed on the sensor conditioner 204 is to be such a value that a load applied by the jig 203 is cancelled.

When adjusting a load balance to make the pressing force of the blade 31 uniform in the longitudinal direction of the blade 31, the load balance is adjusted by turning the adjustive screws 37 in such a manner that differentials of values of the load cells 201 displayed on the sensor conditioner 204 are to fall within a margin of plus or minus 10 grams.

When adjusting the pressing force of the blade 31, it is fundamentally necessary to adjust the contact pressure between the blade 31 and the surface of the photoconductor 10 to be a target value. However, a contact width (nip width) between the blade 31 and the surface of the photoconductor 10 is difficult to measure. Therefore, the pressing force is generally adjusted in such a manner that a linear pressure is to be a target value. The linear pressure means a pressure applied on a contact point between the blade 31 and the surface of the photoconductor 10 per unit length in the photoconductor rotation-axis direction. Specifically, a linear pressure (N/cm) is a value obtained by dividing the total load of summing values of the load cells 201 displayed on the sensor conditioner 204 by a length T3 of the blade 31 in the longitudinal direction.

According to the first embodiment, the pressure force is adjusted to lead the sum total (total load) of values displayed on the sensor conditioner 204 to 26.0 plus or minus 0.29 newton, so that the linear pressure is to be as high as a linear pressure set by the conventional counter type, i.e., approximately 0.790 N/cm. As a warp in the blade 31 is the larger, the contact width between the blade 31 and the surface of the photoconductor 10 is the longer as described above, and moreover, as a deformation in the blade 31 is the larger, the contact width is the longer. In the cleaning device 30 according to the first embodiment, a warp in the blade 31 is restricted with the horizontal portion 32A as described above, so that the warp in the blade 31 hardly occurs. Consequently, the warp can be ignored when comparing with a warp in a blade of the cleaning device of the conventional counter type shown in FIG. 17B. Therefore, in the cleaning device 30 according to the first embodiment, the contact width mainly depends on elastic deformation (compressive deformation) of the blade in the photoconductor-surface moving direction. Thus, the cleaning device 30 according to the first embodiment can make the contact width shorter than that in the cleaning device of the conventional counter type shown in FIG. 17B. As a result, according to the first embodiment, wear on the photoconductor 10 and the blade 31 can be reduced relatively to the cleaning device of the conventional counter type.

Moreover, because the cleaning device 30 according to the first embodiment can make a shorter contact width, even if pressing the blade 31 with a linear pressure as high as that applied by the cleaning device of the conventional counter type, a contact pressure generated by the linear pressure is higher than that in the cleaning device of the conventional counter type. Conversely, to obtain a contact pressure as high as that in the cleaning device of the conventional counter type, the cleaning device 30 requires a smaller pressing force of the blade 31 than the cleaning device of the conventional counter type. The contact width in the first embodiment is expected to be substantially shorter than that in the cleaning device of the conventional counter type. Based on the expectation, it is conceivable that a substantially lower linear pressure than that generated in the cleaning device of the conventional counter type can achieve a contact pressure as high as that in the cleaning device of the conventional counter, and the similar removal performance. This is also effective to reduce wear on the photoconductor 10 and the blade 31.

Moreover, the cleaning device 30 according to the first embodiment can more easily increase the contact pressure than the cleaning device of the conventional counter type. Accordingly, the cleaning device 30 can deliver a sufficient removal performance on toners of spherical particles in small diameters, which are difficult to be removed by the cleaning device of the conventional counter type.

The force assistance unit, such as the springs 36, is not necessarily to be provided, so that the end of the horizontal portion 32A can be connected to the frame 33 without such force assistance unit. However, in such case, the blade holder 32 cannot be displaced in relation to the frame 33. Consequently, in a case where a positional relation between the frame 33 and the photoconductor 10 is fixed, if a distance relation between the frame 33 and the surface of the photoconductor 10 is changed, e.g., due to eccentricity of the photoconductor 10, the blade holder 32 cannot be displaced in response to the change. Therefore, a high manufacturing precision is required such that the distance relation between the frame 33 and the surface of the photoconductor 10 is not to be changed. Moreover, a high assembling precision is also required for assembling the blade 31 to the photoconductor 10. By contrast, in a case where the force assistance unit as used in the first embodiment is provided, even if a distance relation between the frame 33 and the surface of the photoconductor 10 is changed, e.g., due to eccentricity of the photoconductor 10, the blade holder 32 can be displaced in accordance with the change. Accordingly, a high precision is required neither for the distance relation between the frame 33 and the surface of the photoconductor 10, nor for assembling the blade 31 to the photoconductor 10.

In the first embodiment, the blade 31 is in the shape of a rectangular parallelepiped longitudinally extending in the photoconductor rotation-axis direction (y axis direction). Lengths T1 and T2 (see FIG. 4) of two surfaces, i.e., an upstream side surface 31*a* and a downstream side surface 31*b*, respectively, are lengths orthogonal to the contact edge on the two surfaces 31*a* and 31*b*, which adjoin each other with respect to the contact edge as shown in FIG. 1. The length T2 is formed longer than the length T1. Instead of such rectangular parallelepiped, the blade 31 can take any three-dimensional shape that has the two surfaces 31*a* and 31*b* adjoining each other with respect to the contact edge, and allows the blade 31 to satisfactorily remove deposit on the photoconductor surface along the photoconductor rotation-axis direction. Each of the outer surfaces of the blade 31 is not necessarily flat, but can be curved.

Figure 17A:
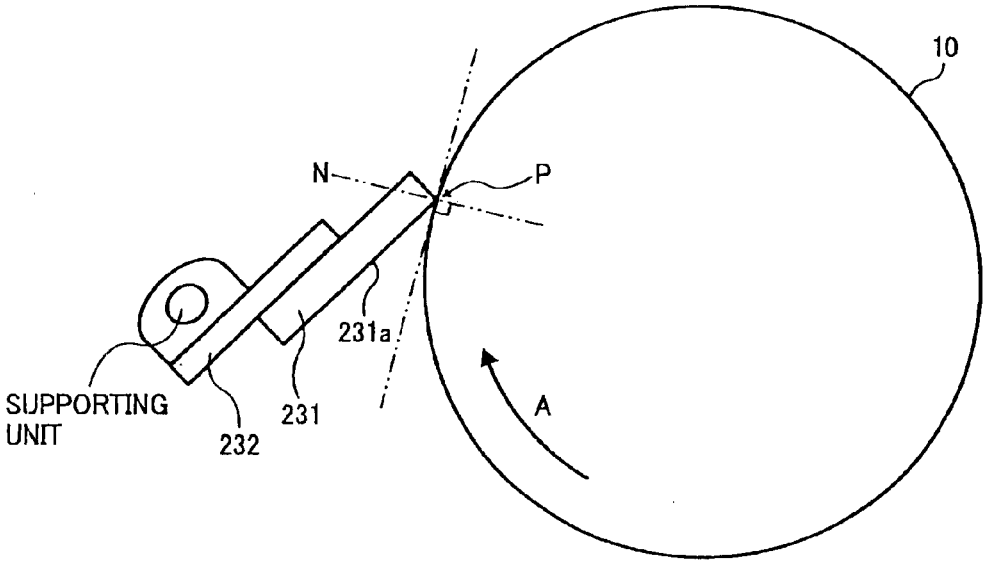
FIG. 17A RELATED ART
FIG. 17A is a schematic diagram for explaining a conventional cleaning device of a trailing type.
Figure 17B:
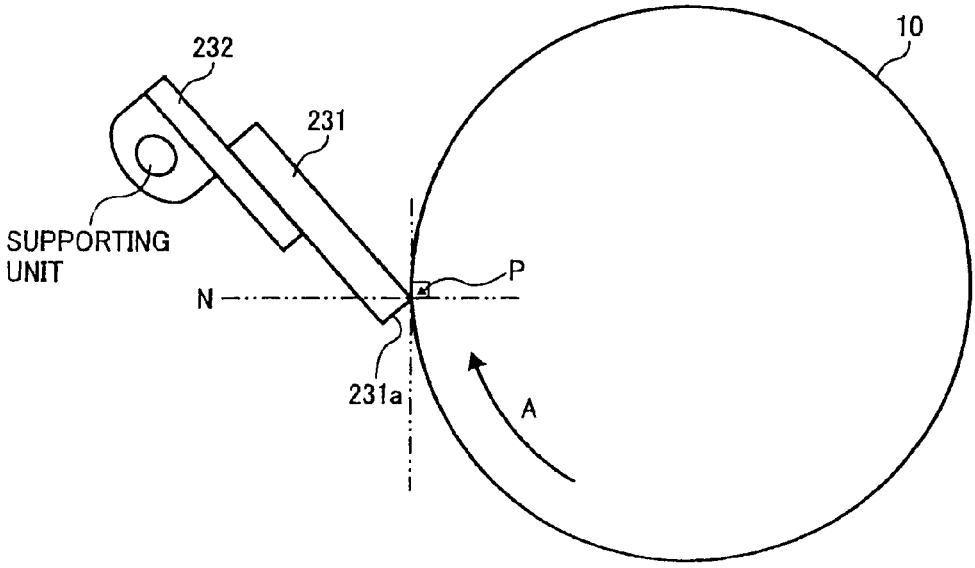
FIG. 17B RELATED ART
FIG. 17B is a schematic diagram for explaining a conventional cleaning device of a counter type.

The shorter length of the blade 31 along a direction of compressive deformation caused by moving the surface of the photoconductor 10 results in the smaller extent of elastic deformation due to the compressive deformation. A length of the blade 31 in the compression direction is approximately equivalent to the length T2 of the downstream side surface 31*b* in the photoconductor-surface moving direction. In FIG. 17B, when measuring a length of each surface of the cleaning blade 231 in a direction orthogonal to the contact edge on the corresponding surface, a length T1 is a length of the upstream side surface 231*a*, and a length T2 is a length of a downstream side surface 231*b*. Comparing the length T2 according to the first embodiment with the length T2 in the cleaning device of the conventional counter type shown in FIG. 17B, the former is much shorter than the latter. Consequently, at least comparing the extents of elastic deformations, the cleaning device 30 would have less deformation than the cleaning device of the conventional counter type. Thus, it is obvious that the contact width in the cleaning device 30 according to the first embodiment is shorter than that in the cleaning device of the conventional counter type.

When the blade 31 in the shape of a rectangular parallelepiped is used similarly to the first embodiment, the lengths T1, T2, and T3 of the edges of the rectangular parallelepiped are preferably configured to satisfy $T3>T1\geqq T2$. More preferably, T2 is not less than one millimeter, and not more than T1. If T2 is less than one millimeter, an unusual noise occurs more easily. If a pressure-relieving elastic material is used for the blade 31, or a material with a high degree in JIS A-hardness is selected, a wider preferable range of the lengths can be achieved. The lengths of the blade 31 according to the first embodiment are as follows: T1 is 12 millimeters, T2 is 4 millimeters, and T3 is 325 millimeters; however, the lengths are not thus limited.

The blade 31 according to the first embodiment uses polyurethane rubber that has JIS A-hardness 75 degree, as a material. The material and hardness of the blade 31 are not thus limited, and can be appropriately selected.

The blade holder 32 according to the first embodiment is made from a metal material mainly containing iron, which has a sufficient rigidity to suppress a warp satisfactorily, even if the blade 31 receives a force from the photoconductor 10 while the photoconductor 10 is rotating in operation.

According to the first embodiment, the cleaning device is configured to press the blade 31 on the surface of the photoconductor 10 in such a manner that an upstream side part in the photoconductor-surface moving direction of the downstream side surface 31*b* of the blade 31 and a downstream side part in the surface moving direction of the tangent line M to the contact point P on the surface of the photoconductor 10 form an angle θ (hereinafter "contact angle") of approximately 15 degrees when the blade 31 is not pressed on the surface of the photoconductor 10 (see FIG. 1). The contact angle θ is appropriately set within a range between 5 degrees and 50 degrees. It is difficult to set the contact angle θ to less than 5 degree due to the layout around the photoconductor 10. If the contact angle θ is set to more than 50 degrees, it is much difficult to achieve a sufficient removal performance. More preferably, the contact angle θ is set within a range between 7 degrees and 40 degrees.

In the first embodiment, the whole of the opposed surface of the upstream side surface 31*a* of the blade 31 is bonded to the horizontal portion 32A of the blade holder 32, as shown in FIG. 1. A bonding method other than the adhesive bonding employed in the first embodiment, such as bonding with double-faced adhesive tape, or hot melt, can be employed. Thus, according to the first embodiment, even if the photoconductor 10 is rotated while the blade 31 is pressed onto the surface of the photoconductor 10, a substantial warp in the blade 31 hardly occurs.

Accordingly, robustness against environmental variation is improved. More specifically, in a configuration that a warp in a blade may occur, such as a case where a free length of the blade is long, a force caused by the warp in the blade is changed depending on humidity. For example, if a warped blade is left as it is in a hot and humid environment, the blade is plastically deformed, and a permanent set occurs. In such case, the attitude of the blade to the surface of the photoconductor 10 changes, and a cleaning performance is degraded, so that there is a possibility that a cleaning failure may occur. By contrast, in the first embodiment where a substantial warp in the blade 31 hardly occurs, robustness against environmental variation can be improved.

Occurrence of a warp in a blade means that the blade has a flexibility that allows the blade to warp. If the flexibility of the blade is large, in a case of the counter type, a blade turnup, which is a serious problem, easily occurs, when a friction force between the blade and the photoconductor surface increases. In the first embodiment where a substantial warp in the blade 31 does not occur, a blade turnup is prevented.

According to the first embodiment, an end of the horizontal portion 32A facing the surface of the photoconductor 10, i.e., the end of the horizontal portion 32A coupled to the vertical portion 32B, is arranged at the same position as a border edge between the opposed surface (bonding surface) of the upstream side surface 31*a* and the downstream side surface 31*b*, as shown in FIG. 1. However, even if the end of the horizontal portion 32A is arranged to extend closer to the surface of the photoconductor 10 than the border edge of the blade 31, a substantial warp in the blade 31 hardly occurs, similarly to the first embodiment.

Alternatively, the end of the horizontal portion 32A does not need to be extended until the border edge of the blade 31. As long as a warp in the blade 31 can be virtually restricted, the end of the horizontal portion 32A does not need to reach the border edge. In other words, if a warp in the blade 31 is virtually restricted, the end of the horizontal portion 32A can be more distant from the photoconductor surface than the border edge. In such case, to what extent the end of the horizontal portion 32A can keep an additional distance from the photoconductor surface relative to the border edge is determined depending on hardness of the blade 31, a friction coefficient between the blade 31 and the surface of the photoconductor 10, and the like. An allowable range of the distance can be, for example as a guidepost for determination, a distance according to which a resultant length (contact width) of a contact point in the photoconductor-surface moving direction is to be not more than 50 micrometers, when pressing the blade 31 onto the surface of the photoconductor 10 to apply a linear pressure of 0.790 N/cm. It is estimated that up to a quarter of the length T2 of the downstream side surface 31*b* can be allowable as a distance between the end of the horizontal portion 32A and the border edge. Furthermore, there is a possibility that a range from a half of T2 up to the almost same level as T2 can be allowable.

Moreover, the blade 31 can be bonded to the horizontal portion 32A of the blade holder 32 by applying adhesive to only part of the bonding surface of the blade 31. However, it is desirable that bonding is performed at least on a marginal area close to the surface of the photoconductor 10 from across an overlapping area where the horizontal portion 32A and the opposed surface (bonding surface) of the upstream side surface 31*a* overlap one another. As the horizontal portion 32A of the blade holder 32 and the blade 31 are securely bonded in the end area, flapping of the blade 31 can be stably prevented, even if a friction force between the blade 31 and the photoconductor surface is changed for some reasons while the photoconductor is rotating in operation. This is the same to other bonding methods.

Figure 6:
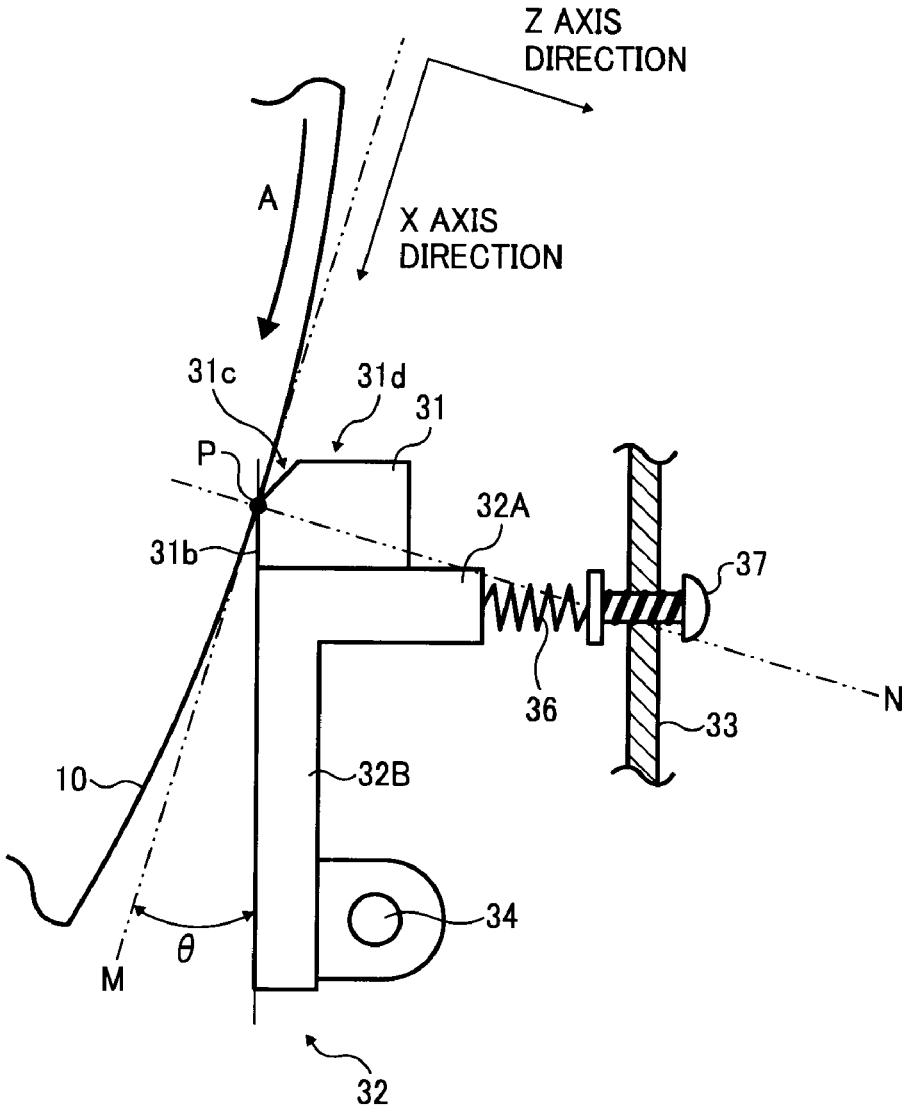
FIG. 6 is a schematic diagram for explaining relevant parts of a cleaning device, viewed from a photoconductor rotation-axis direction, according to a modification of the present invention.

FIG. 6 is a schematic diagram for explaining relevant parts of a cleaning device according to a modification of the cleaning device 30 viewed from the photoconductor rotation-axis direction.

In the cleaning device according to the modification, an upstream side surface of the blade 31 includes a first upstream side-surface 31*c* and a second upstream side-surface 31*d*. The first upstream side-surface 31*c* is adjacent to the downstream side surface 31*b*. The second upstream side-surface 31*d* extends in substantially parallel with a direction (substantially the same as a direction along which the horizontal portion 32A of the blade holder 32 extends) orthogonal to both of two directions, i.e., the direction of a force received by a contact edge from the photoconductor surface when moving the surface of the photoconductor 10 (substantially the same as a direction along which the vertical portion 32B of the blade holder 32 extends), and the longitudinal direction of the blade 31. The blade 31 is configured to have an obtuse angle between the back surface of the first upstream side-surface 31*c* and the back surface of the downstream side surface 31*b* (hereinafter, "blade tip angle δ"). Other configurations than the blade tip angle of the cleaning device 30 according to the modification are similar to those according to the first embodiment.

According to the cleaning device 30 of the modification, the following effects can be obtained.

Generally, the blade tip angle is 90 degrees as described in the first embodiment. However, the present inventors revealed that a blade having the blade tip angle larger than 90 degrees, i.e., an obtuse angle, can largely reduce wear amount on the blade 31. The reason why the wear amount on the blade 31 can be largely reduced is explained below. The blade 31 is deformed by receiving an effect of a friction force between the blade 31 and the surface of the photoconductor 10, and the amount of the deformation in a case of an obtuse blade tip angle is smaller than that in a case when the blade tip angle is 90 degrees. The contact width between the blade 31 and the surface of the photoconductor 10 in the case of an obtuse blade tip angle is smaller than that in the case when the blade tip angle is 90 degrees, thereby reducing the wear amount on the blade 31. When the contact width becomes smaller, the contact pressure generated by the same pressing force with the blade 31 onto the surface of the photoconductor 10 is increased. Conversely, to obtain the contact pressure, the pressing force can be reduced. Thus, toner can be removed with a smaller pressing force.

Figure 7:
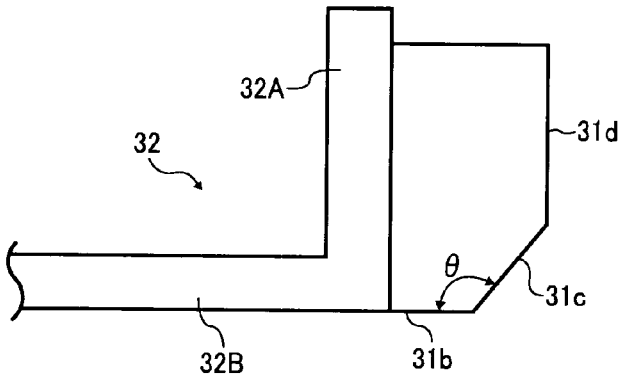
FIG. 7 is a perspective view of relevant parts of the cleaning device shown in FIG. 6.

According to the modification, the blade tip angle is 120 degrees. As shown in FIG. 7, the blade tip angle is preferably between 95 degrees and 140 degrees. Particularly, a blade having an obtuse angle smaller than 95 degrees cannot achieve a sufficient effect.

Toners to be used in the printer according to the first embodiment are explained below.

Because the cleaning device 30 according to the first embodiment can achieve an excellent removal performance, the cleaning device 30 can be used for removing a toner having the average circularity of 0.940 or more, and further that between 0.960 and 0.998. Furthermore, effects of the present invention can be sufficiently delivered for removing a toner having the average circularity between 0.960 and 0.998.

Such toner can be obtained by thermally or mechanically conglobating a toner manufactured by dry grinding. As a thermal conglobation process, it can be considered that toner particles are sprayed together with hot air by atomizer. As mechanical conglobation process, it can be considered that toner particles are charged and stirred in a mixer, such as a ball mill, together with a mixing medium, such as glass of light specific gravity. However, a further classification process is required, because toner particles having a large diameter are produced by agglomerating in the thermal conglobation process, and microparticles are produced in the mechanical conglobation process. If a toner is manufactured in an aqueous solvent, the spherical shape can be controlled by giving a strong stir during a process of removing the solvent.

The circularity of a toner is a value obtained by optically detecting toner particles, and the circumferential length of a circle which has an area equivalent to the projection area of the toner is divided by a circumferential length of an actual toner particle. Specifically, the average circularity of the toner is measured using a flow particle image analyzer (FPIA-2000; manufactured by SYSMEX Corp.). In to a given vessel, 100 milliliters to 150 milliliters of water from which solid impurities are preliminarily removed is charged, 0.1 milliliter to 0.5 milliliter of a surfactant is added as a dispersant, and approximately 0.1 gram to 9.5 grams of a sample of a toner is further added. The suspension of the dispersed sample is dispersed for approximately one minute to three minutes using an ultrasonic dispersing apparatus, to make a concentration of the dispersant 3,000 pcs/μL to 10,000 pcs/μL, and then the shape and distribution of the toner is measured. The circularity is defined as follows: Circularity SR=(circumferential length of circle having area equivalent to projection area of toner/circumferential length of actual toner particle). When the toner is the closer to a complete spherical, the circularity is the closer to 1.

A toner having a high circularity tends to be influenced by electric flux line on the carrier or on the surface of the developing roller 51, and an image is precisely developed along the electric flux line of an electrostatic latent image. Accordingly, when reproducing fine latent image dots, a minute and uniform toner arrangement is made, so that reproducibility of a thin line is high. The toner having a high circularity has a smooth surface and adequate flow ability, so that the toner tends to be influenced by electric flux line, an image can be precisely and easily transferred along the electric flux line, a transfer rate is high, and a high quality of the image can be obtained. The primary transfer roller 161 presses the intermediate transfer belt 162 with pressure and comes in contact, so that the primary transfer nip is formed. A transfer electric field is then formed by applying a transfer voltage of the reversed polarity to the toner image onto the primary transfer roller 161. When the toner image formed on each of the photoconductors 10 is transferred primarily onto the intermediate transfer belt 162, the toner having a high circularity touches the intermediate transfer belt 162, and contact area of the toner becomes uniform, thereby improving the transfer rate.

However, if the average circularity of the toner is less than 0.93, precise development and transfer at high transfer rate cannot be achieved. The reason for this is because if the toner has amorphous shapes, electrostatic charge on the toner surfaces is not uniform, and the center of gravity and the center of electrostatic charge are deviated, so that it is difficult to achieve precise movement in accordance with the electric field.

In terms of volume average diameter of the toner, the smaller value can improve the reproducibility of a thin line, a toner having the diameter at most seven micrometers or smaller is preferably used. However, because the smaller particle diameter degrades development properties, the particle diameter is preferably at least three micrometers or larger. If the diameter is less than three micrometers, microparticles of a toner that are difficult to be developed on the carrier or the surface of the developing roller 51 are increased. As a result, contact and friction of other toners with the carrier or the developing roller 51 becomes insufficient, so that reversely charge toners are increased. Accordingly, an erroneous image, such as fog, is formed, which is unfavorable. If a toner has the volume average diameter of two micrometers or more, the cleaning device 30 can deliver a sufficient removal performance. Particularly, if the volume average diameter is three micrometers or more, more favorable removal performance can be delivered. The ratio between a volume average diameter Dv and a number average diameter Dn is preferably between 1.0 and 1.4 approximately.

The volume average diameter of a toner is measured as follows.

A surfactant (preferably, alkylbenzene sulfonate) as dispersant between 0.1 milliliter and 5 milliliters is added into 100 milliliters to 150 milliliters of an electrolyte aqueous solution. The electrolyte solution is a 1% NaCl aqueous solution prepared by using a first grade sodium chloride, that is, ISOTON R-II (manufactured by Coulter Scientific Japan, Ltd.) is used. In to the mixed solution, 2 milligrams to 20 milligrams of a sample of a toner is added, suspended in the electrolyte solution, and dispersed for approximately one minute to three minutes using an ultrasonic dispersing apparatus. With the measuring device, using a 100 micrometer aperture, the volume and the number of pieces in the sample of the toner are measured channel by channel, and then the distribution of volumes and the distribution of the number of pieces of the toner are calculated.

The following 13 channels are used: from 2.00 micrometers to 2.52 micrometers; from 2.52 micrometers to 3.17 micrometers; from 3.17 micrometers to 4.00 micrometers; from 4.00 micrometers to 5.04 micrometers; from 5.04 micrometers to 6.35 micrometers; from 6.35 micrometers to 8.00 micrometers; from 8.00 micrometers to 10.08 micrometers; from 10.08 micrometers to 12.70 micrometers; from 12.70 micrometers to 16.00 micrometers; from 16.00 micrometers to 20.20 micrometers; from 20.20 micrometers to 25.40 micrometers; from 25.40 micrometers to 32.00 micrometers; and from 32.00 micrometers to 40.30 micrometers.

From among toners that satisfies the average circularity described above, a toner of which a shape factor SF-1 falls within a range between 100 and 160, and of which a shape factor SF-2 falls within a range between 100 and 160 is preferable.

Figure 8A:
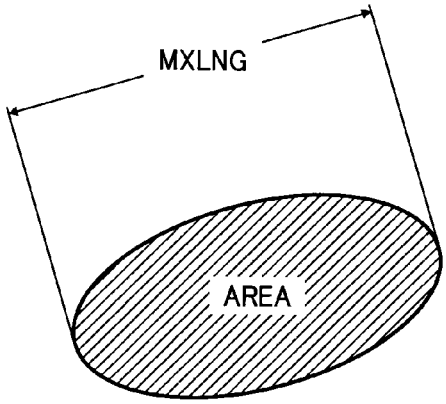
FIGS. 8A and 8B are schematic diagrams of shapes of toners.
Figure 8B:
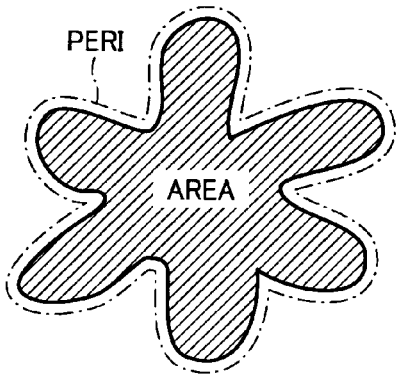

FIGS. 8A and 8B are schematic diagrams of shapes of toners. FIG. 8A is a schematic diagram for explaining the shape factor SF-1, and FIG. 8B is a schematic diagram for explaining the shape factor SF-2.

The shape factor SF-1 indicates a degree of roundness of a toner shape, and presented in the following Equation (1). The square of the maximum length MXLNG of a projection shape created by projecting a toner particle onto a two-dimensional flat plane is divided by the graphic area AREA, and multiplied by 100π/4. When the SF-1 is 100, the toner particle has a complete spherical shape. As the SF-1 increases, the toner shape becomes more amorphous.

$$SF\text{-}1=\{(MXLNG)^2/(\text{AREA})\}\times(100\pi/4) \quad (1)$$

The shape factor SF-2 indicates the degree of the concavity and convexity of a toner shape, and presented in the flowing Equation (2). The square of the periphery PERI of the projection shape is divided by the graphic area AREA, and multiplied by 100π/4. When the SF-2 is 100, the surface of the toner particle does not have concavity and convexity. As the SF-2 increases, the toner surface is much rougher.

$$SF\text{-}2=\{(PERI)^2/(\text{AREA})\}\times(100/4\pi) \quad (2)$$

To determine the shape factors, specifically, a photograph of particles of a toner is taken using a scanning electron microscope (S-800, manufactured by Hitachi Ltd.); and the taken particle images are analyzed using an image analyzer (LUSEX 3 manufactured by Nireco Corp.).

When the toner has a particle shape near the complete spherical shape, the contact area of a particle of the toner with another particle decreases and turns to point contact. As a result, the adhesion between the toner particles decreases, and flow ability of the toner increases. Moreover, absorbability between the toner particles and the photoconductor 10 decreases, the transfer rate increases, so that residual toner particles remaining on the surface of the photoconductor 10 can be cleaned more easily. As the shape factors SF-1 and SF-2 increase, the shape turns to be amorphous, the distribution of the charge amount of the toner is widened, the development image is less precise to the latent image, and transfer is not performed precisely in accordance with the transfer electric field, resulting in degradation of the image qualities. Therefore, it is preferred that the shape factors SF-1 and SF-2 do not exceed 180.

A substantially spherical toner as described above can be preferably obtained by crosslinking and/or elongating toner constituents including a polyester prepolymer having a functional group having a nitrogen atom, a polyester, a colorant, and a release agent, in an aqueous medium under presence of resin particles. According to a manufacturing method of conventional grinded toners, comparing to any parameter of the circularity, the average diameter, and the shape factors SF-1 and SF-2, satisfactory toner cannot be produced, or the toner produced by polymerization has advantages in terms of manufacturing costs and yield. However, among toners produced by the polymerization, it is difficult for a toner produced by the suspension polymerization or emulsion polymerization to obtain a complete spherical shape. Particularly, a toner produced by a dissolving suspension has a kind of spherical shape, but amorphous toner, so that satisfactory image quality is hardly obtained.

Constituent materials and preferable producing methods of the toner obtained by crosslinking and/or elongating toner constituents including a polyester prepolymer having a functional group having a nitrogen atom, a polyester, a colorant, and a release agent, in an aqueous medium under presence of resin particles, are explained below. Polyester is obtained by polycondensation reaction between polyhydric alcohol compounds and polyvalent carboxylic acid compounds.

Examples of polyhydric alcohol compounds (PO) include dihydric alcohol (DIO) and trihydric or more alcohols (TO); and dihydric alcohol (DIO) alone or a mixture of dihydric alcohol (DIO) with a small amount of trihydric alcohol (TO) are preferable.

Examples of dihydric alcohol (DIO) include alkylene glycol having a carbon number from 2 to 12 and the adducts of alkylene oxides of the bisphenols. Particularly preferable are the adducts of alkylene oxides of the bisphenols, and a combination of the adducts of alkylene oxides of the bisphenols and alkylene glycol having a carbon number from 2 to 12.

Trihydric or more alcohols (TO) include trihydric to octahydric alcohols and more aliphatic alcohols (e.g., glycerol, trimethylolethane, trimethylolpropane, pentaerythritol, and sorbitol); trivalent or more phenols (e.g., trisphenol PA, phenol novolak, and cresol novolak); and adducts of alkylene oxides of the trivalent or more polyphenols.

Examples of a polyvalent carboxylic acid (PC) include a divalent carboxylic acid (DIC) and a trivalent or more carboxylic acid (TC). The divalent carboxylic acid (DIC) alone and a mixture of the divalent carboxylic acid (DIC) and a small amount of the trivalent or more carboxylic acid (TC) are preferable. Examples of divalent carboxylic acids (DIC) include the alkenylene dicarboxylic acids having a carbon number from 4 to 20 and the aromatic dicarboxylic acids having a carbon number from 8 to 20. Examples of trivalent or more carboxylic acids (TC) include aromatic polyvalent carboxylic acids having a carbon number from 9 to 20 (e.g., trimellitic acid and pyromellitic acid).

A ratio between the polyhydric alcohol (PO) and the polyvalent carboxylic acid (PC) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

For polycondensation reaction, under presence of an esterification catalyst, such as tetrabutoxy titanate or dibutyltin oxide, a polyvalent alcohol (PO) and a polyvalent carboxylic acid (PC) are heated to between 150° C. and 280° C., the pressure is reduced as required, and produced water is removed, so that a polyester having a hydroxyl group is obtained.

The polyesters include an unmodified polyester obtained from the polycondensation, and moreover, preferably a urea modified polyester. An urea modified polyester is obtained as follows: a carboxyl group or a hydroxyl group at an end of a polyester obtained by the polycondensation, and a polyvalent isocyanate compound (PIC) are exposed to reaction; a polyester prepolymer (A) having an isocyanate group is obtained; the obtained polyester prepolymer (A) and amines are exposed to reaction so that molecular chains are crosslinked and/or elongated.

Examples of polyvalent isocyanate compounds (PIC) are aliphatic polyvalent isocyanates, alicyclic polyisocyanates, aromatic diisocyanates, aromatic aliphatic diisocyanates, isocyanates, compounds formed by blocking these polyisocyanates by a phenol derivative, an oxime, a caprolactam and a combination of at least two of these.

A ratio of the polyvalent isocyanate compounds (PIC) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester.

The content of the polyvalent isocyanate compound (PIC) in the isocyanate group-containing polyester prepolymer (A)

ranges usually from 0.5 wt % to 40 wt %, preferably from 1 wt % to 30 wt %, and more preferably from 2 wt % to 20 wt %.

The number of isocyanate groups contained in one molecule of the isocyanate group-containing polyester prepolymer (A) is usually at least 1, preferably, an average of 1.5 to 3, and more preferably, an average of 1.8 to 2.5.

Further, amines (B) that are reacted with the polyester prepolymer (A) include divalent amine compounds (B1), trivalent or more amine compounds (B2), amino alcohols (B3), amino mercaptans (B4), amino acids (B5), and the compounds (B6) of B1 to B5 in which their amino groups are blocked.

Examples of the divalent amine compounds (B1) include aromatic diamines, alicyclic diamines, and aliphatic diamines.

Examples of the trivalent or more amine compounds (B2) include diethylene triamine and triethylene tetramine.

Examples of the amino alcohols (B3) include ethanolamine and hydroxyethylaniline.

Examples of the amino mercaptans (B4) include aminoethyl mercaptan and aminopropyl mercaptan.

The preferable amines among the amines (B) are B1 and a mixture of B1 with a small amount of B2.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B).

The urea-modified polyester is manufactured by a one shot method. Polyhydric alcohol (PO) and polyvalent carboxylic acid (PC) is heated to 150° C. to 280° C. in the presence of a known esterification catalyst such as tetrabutoxytitanate and dibutyltin oxide, and by distilling water generated while pressure is reduced if required, and polyester having the hydroxyl group is obtained. Polyvalent isocyanate compound (PIC) is reacted with the polyester at a temperature of 40° C. to 140° C. to obtain isocyanate group-containing polyester prepolymer (A). The amine group (B) is further reacted with (A) at the temperature of 0° C. to 140° C. to obtain the urea-modified polyester.

When (PIC) is reacted or (A) and (B) are reacted, a solvent can be used if necessary. Examples of available solvent include those inactive to isocyanate, such as an aromatic solvent, ketone group, and ester group.

A reaction inhibitor is used as required for crosslinking reaction and/or elongation reaction between polyester prepolymer (A) and amines (B), thereby adjusting the molecular weight of the urea-modified polyester obtained. Examples of the reaction inhibitor include monoamines (e.g., diethylamine, dibutylamine, butylamine, and laurylamine), and ketimine compounds in which the monoamines are blocked.

The weight-average molecular weight of the urea-modified polyester is usually not less than 10,000, preferably 20,000 to 10,000,000, and more preferably 30,000 to 1,000,000. A number-average molecular weight of the urea-modified polyester is not particularly limited when the native polyester is used, and the number-average molecular weight should be one that is easily obtained to get a weight-average molecular weight. When the urea-modified polyester is used alone, the number-average molecular weight is usually 2,000 to 15,000, preferably 2,000 to 10,000, and more preferably 2,000 to 8,000.

A weight ratio between the native polyester and the urea-modified polyester is usually 20/80 to 95/5, preferably 70/30 to 95/5, more preferably 75/25 to 95/5, and particularly preferably 80/20 to 93/7. A glass transition point (Tg) of binder resin including the native polyester and the urea-modified polyester is usually set to be 45° C. to 65° C., and preferably 45° C. to 60° C.

As for a colorant, all known dyes and pigments are available for a colorant, and the followings and mixtures thereof can be used, e.g., carbon black, nigrosine dye, naphthol yellow S, cadmium yellow, yellow iron oxide, chrome yellow, minium, red lead, cadmium red, lithol fast scarlet G, benzidine orange, oil orange, cobalt blue, cerulean blue, alkali blue lake, fast sky blue, indigo, ultramarine blue, Prussian blue, manganese violet, dioxane violet, chrome green, pyridian, emerald green, pigment green B, phthalocyanine green, and anthraquinone green. The content of the colorant is usually 1 wt % to 15 wt %, and preferably 3 wt % to 10 wt % in toner particles.

The colorant can also be used as a master batch mixed with resin. Examples of binder resin used to manufacture such a master batch or to be kneaded with the master batch include styrenes such as polystyrene, poly-p-chlorostyrene, polyvinyltoluene, and substituted polymer thereof, or copolymer of these compounds and vinyl compounds, polymethyl methacrylate, polyvinyl chloride, polyvinyl acetate, polyethylene, polypropylene, polyester, epoxy resin, chlorinated paraffin, and paraffin wax. These materials can be used alone or as a mixture thereof.

Known charge control agents can be used as a charge control agent, and include, e.g., nigrosine dyes, triphenylmethane dyes, chromium-containing metal complex dyes, phosphorus alone or compounds thereof, tungsten alone or compounds thereof, fluorine-based active agents, salicylic acid metal salts, and metal salts of salicylic acid derivatives. More specific examples of the charge control agents are Bontron 03 as nigrosine dyes, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium salt, Copy Blue PR as triphenylmethane derivative, LRA-901 and LR-147 as boron complex (manufactured by Japan Carlit Co., Ltd.), copper phthalocyanine, perylene, quinacridone, azo type pigments, and polymer compounds having a functional group such as a sulfonic acid group, a carboxyl group, and a quaternary ammonium salt group. Among these, a material that controls the toner to have negative polarity is preferably used.

The use amount of the charge control agent is determined depending on the type of binder resins, presence or absence of additives to be used as required, and a method of manufacturing toner including a dispersion method, and hence, it is not uniquely limited. However, the charge control agent is used preferably in a range from 0.1 parts by weight (wt. parts) to 10 wt. parts, and more preferably from 0.2 wt. parts to 5 wt. parts, per 100 wt. parts of the binder resin. If it exceeds 10 wt. parts, the toner is charged too highly, which causes effects of the charge control agent to be decreased, electrostatic attracting force with a developing roller to be increased, fluidity of the developer to be lowered, and image density to be reduced.

A wax having a low melting point in a range from 50° C. to 120° C. effectively functions as a release agent in dispersion with binder resin. Such wax components include the followings. Examples of waxes include waxes from plants such as carnauba wax and cotton wax; waxes from animals such as beeswax and lanolin; waxes from mineral substances such as ozokerite and cercine; and petroleum waxes such as paraffin, microcrystalline, and petrolatum.

Examples of waxes apart from these natural waxes include synthetic hydrocarbon waxes such as Fischer-Tropsch wax and polyethylene wax; and synthetic waxes such as ester, ketone, and ether.

Inorganic fine particles are preferably used as an external additive to facilitate fluidity, developing performance, and chargeability of toner particles. Such an inorganic fine particle has preferably a primary particle diameter of $5\times10^{-3}$ to 2 micrometers. In particular, the primary particle diameter is preferably $5\times10^{-3}$ to 0.5 micrometers.

A specific surface area by the BET method is preferably 20 $m^2/g$ to 500 $m^2/g$. The use ratio of the inorganic fine particles is preferably 0.01 wt % to 5 wt % in toner particles, and more preferably 0.01 wt % to 2.0 wt %.

Specific examples of the inorganic particles include silica, alumina, titanium oxide, barium titanate, zinc oxide, calcium carbonate, silicon carbide, and silicon nitride. Among these materials, hydrophobic silica particles and hydrophobic titanium oxide particles are preferably used in combination as a fluidizing agent.

A method of producing toner is explained below in detail. In the following description, although a preferred method is shown, the present invention is not limited to this.

A colorant, an unmodified polyester, a polyester prepolymer having an isocyanate group, and a release agent are dispersed into an organic solvent, and then a toner material solution is prepared. The organic solvent is preferably volatile with a boiling point lower than 100° C., because the organic solvent can be easily removed after toner base-particles are formed. Specifically, an aromatic solvent, such as toluene or xylene; a halogenated hydrocarbon, such as methylene chloride, 1, 2-dichloroethane, chloroform, or carbon tetrachloride; and the like can be used alone or in combination of two or more of those. The amount of the organic solvent to be used for 100 wt. parts of the polyester prepolymer is generally between 0 wt. part and 300 wt. parts, preferably between 0 wt. part and 100 wt. parts, and more preferably between 25 wt. part and 70 wt. parts.

The toner material solution is emulsified in an aqueous medium including a surfactant and resin microparticles. The aqueous medium can be water alone, or can include an organic solvent: an alcohol, such as methanol; dimethylformamide; tetrahydrofuran; one of Cellosolves; one of lower ketones; or the like. The amount of the aqueous medium to be used for 100 wt. parts of the toner material solution is generally between 50 wt. parts and 2,000 wt. parts, and preferably between 100 wt. parts and 1,000 wt. parts. If the amount of aqueous medium is less than 50 wt. parts, toner materials are not dispersed sufficiently in the toner material solution, so that a predetermined particle diameter of toner particles is not satisfied. If the amount of the aqueous medium is more than 20,000 wt. parts, it is not favorable in terms of costs.

To achieve satisfactory dispersion in the aqueous medium, a dispersant, such as a surfactant and resin microparticles, can be added as required. The surfactant can be an anionic surfactant, such as alkylbenzene sulfonate; a cationic surfactant of a quaternary ammonium salt, such as alkylamine salt, aminoalcohol fatty acid derivative, polyamine fatty acid derivative, and alkyltrimethyl ammonium salt; or the like. By using a surfactant having a fluoroalkyl group, effects of the surfactant can be obtained in a small amount.

The substances described above can be used as the resin microparticles. Additionally, an inorganic compound dispersant, such as tricalcium phosphate, calcium carbonate, titanium oxide, colloidal silica, and hydroxyapatite, can be used. Material-dispersed fluid can be stabilized with a high-polymer protective colloid, which can be used as a dispersant together with the resin microparticles and an inorganic compound dispersant. For example, an acid can be used, such as acrylic acid, methacrylic acid, α-cyanoacrylic acid, α-cyanomethacrylic acid, itaconic acid, crotonic acid, fumaric acid, maleic acid, or maleic anhydride. Alternatively, an acrylic monomer or a methacrylic monomer containing hydroxyl group can used, such as β-hydroxyethyl acrylate, β-hydroxyethyl methacrylate, β-hydroxypropyl acrylate, β-hydroxypropyl methacrylate, or γ-hydroxypropyl acrylate.

A dispersing method is not particularly limited, and a known facility, e.g., by low-speed shearing, high-speed shearing, friction dispersion, high-pressure jetting, or ultrasonic dispersion, can be applied. To make dispersed particles with particle diameter between 2 micrometers and 20 micrometers, the high-speed shearing method is preferred. When a high-speed shearing dispersing machine is used, the number of rotation is not particularly limited, but is generally between 1,000 rpm and 30,000 rpm, and preferably between 5,000 rpm and 20,000 rpm. A dispersion time is not particularly limited, but is generally between 0.1 minute and 5 minutes in a batch system. The temperature for dispersing is generally between 0° C. and 150° C. under pressure, and preferably between 40° C. and 98° C.

When an emulsified liquid is prepared, an amine (B) is simultaneously added to the emulsified liquid, and is cause to react with a polyester prepolymer (A) having an isocyanate group. The reaction involves cross-linking and/or extending molecular chains. The reaction time for cross-linking and/or extending is appropriately selected in accordance with the reactivity of an isocyanate group structure of the polyester prepolymer (A) to the amine (B), and is generally between 10 minutes and 40 hours, and preferably between 2 hours and 24 hours. The reaction temperature is generally between 0° C. and 150° C., and preferably between 40° C. and 98° C. A known catalyst can be used as required. Specifically, for example, dibutyltin laurate, or dioctyltin laurate can be used.

After the reaction is completed, the organic solvent is removed from the emulsified dispersion (reaction mixture), the residue is washed and dried, and then toner base-particles are obtained. To remove the organic solvent, the entire system is gradually heated while stirring in a laminar flow. In a predetermined range of temperature, the system is strongly stirred, and then the organic solvent is removed, consequently toner base-particles, which are substantially spherical in shape, can be prepared. In the process, another shape, for example, a spindle shape, can be formed from an absolute sphere. Furthermore, morphology of the surface can be controlled, for example, from a smooth surface into a wrinkly one. When an acid such as calcium phosphate or a substance soluble in alkaline is used as a dispersion stabilizer, the calcium phosphate is removed from the toner base-particle by dissolving the calcium phosphate with an acid such as hydrochloric acid, and then washing with water. Alternatively, the calcium phosphate can also be removed by enzymolysis.

A process of maturing the prepared toner particles can be provided, in which the emulsified dispersion liquid is left standing at a certain temperature for a certain time period before or after the process of washing and removing the solvent. The process allows a toner particle to have a desired diameter. The temperature of the maturing process is preferably between 25° C. and 50° C., and the time period is preferably between 10 minutes and 23 hours.

A charge-controlling agent is implanted into the toner base-particles obtained in the above process, and then inorganic microparticles, such as silica microparticles and titanium oxide microparticles, are externally added to the toner base-particles, consequently a toner is produced.

Implanting of the charge-controlling agent and external adding of inorganic microparticles are performed by a known method, for example, by using a mixer.

The method allows toner particles easily to have a sharp distribution of particle diameters, each of which is small.

The toner according to the embodiment of the present invention is mixed with a magnetic carrier to be used as a two-component developer. However, the toner can be used as a magnetic toner or a non-magnetic toner of a one-component developer without using a carrier.

The two-component developer can be made from a magnetic carrier of which particles have diameters between 20 micrometers and 200 micrometers selected from conventionally known magnetic carriers, for example, iron powder, ferrite powder, magnetite powder, and a magnetic resin carrier. As a covering material for the toner, an amino resin, for example, a urea-formaldehyde resin, a melamine resin, a benzoguanamine resin, a urea resin, a polyamide resin, or an epoxy resin, can be used. Moreover, one of polyvinyl resins or polyvinylidene resins, for example, an acrylic resin, a polymethyl methacrylate resin, a polyacrylonitrile resin, a polyvinyl acetate resin, a polyvinyl alcohol resin, and a polyvinyl butyral resin; a polycarbonate resin, a polyethylene resin, a silicon resin, or the like, can be used. In addition, conductive powder can be included in the covering resin material as required. As the conductive powder, metal powder, carbon black, titanium oxide, tin oxide, zinc oxide, or the like, can be used.

The average particle diameter of the conductive powder is preferably one micrometer or smaller. If the average particle diameter is larger than one micrometer, it becomes difficult to control electric resistance.

According to the first embodiment, spherical ferrite particles having an average particle diameter of approximately 50 micrometers are used as a core material. A coating material includes an aminosilane coupling agent and a silicone resin, both of which are dispersed in toluene. The dispersion liquid and the core material are charged into a coating device, in which a rotary base-plate disk and stirring blades are arranged in a fluidized bed to perform coating while making a rotational flow, so that the dispersion liquid is applied over particles of the core material. The resultant coated core material is then calcined in an electric furnace at 250° C. for two hours, as a result, carrier particles coated with a silicon resin layer of 0.5 micrometer in average thickness are prepared. An initial developer is made by uniformly mixing and electrically charging 100 wt. parts of the carrier with 7 wt. parts of a toner described in the following examples by using a tumbler mixer, in which contents are stirred by rotating a container.

Examples of the toner are explained below.

Although toners of respective examples were produced as described below, the present invention is not limited to this.

A toner 1 was produced according to the following procedures.

A resin microparticle emulsion was synthesized as follows: 683 wt. parts of water, 11 wt. parts of sodium salt of methacrylic acid ethylene oxide adduct sulfate (ELEMINOL RS-30, manufactured by Sanyo Chemical Industries, Ltd.), 83 wt. parts of styrene, 83 wt. parts of methacrylic acid, 110 wt. parts of butyl acrylate, and one part of ammonium persulfate were charged into a reaction vessel equipped with a stirrer and a thermometer; and the contents of the reaction vessel were stirred at 3,800 rpm for 30 minutes; as a result, a white emulsion was obtained. The temperature in the system was heated to 75° C., and the obtained white emulsion was exposed to reaction for four hours. Furthermore, the reaction mixture was added with 30 wt. parts of 1% ammonium persulfate aqueous-solution, and then matured at 75° C. for six hours. As a result, a microparticle emulsion 1 was obtained, which was an aqueous dispersion liquid of a vinyl resin (a copolymer of styrene, methacrylic acid, butyl acrylate, and sodium salt of methacrylic acid ethylene oxide adduct sulfate). Diameters of particles in the microparticle emulsion 1 were measured by a laser scattering particle-size distribution analyzer (LA-920, manufactured by HORIBA, Ltd.). It was 110 nanometers in volume average. Part of the microparticle emulsion 1 was dried, and the resin was isolated. The shape of a resin microparticle was spherical. The glass transition temperature (Tg) of the resin was 58° C., and the weight average molecular weight was 130,000.

An aqueous phase was prepared as follows: 990 wt. parts of water, 83 wt. parts of the microparticle emulsion 1, 37 wt. parts of a 48.3% aqueous solution of sodium dodecyl diphenylether disulfonic acid (ELEMINOL MON-7, manufactured by Sanyo Chemical Industries, Ltd.) and 90 wt. parts of ethyl acetate were mixed and stirred; and then a milky-white liquid was obtained. This is an aqueous phase 1.

A low-molecular-weight polyester was synthesized as follows: 724 wt. parts of bisphenol A ethylene oxide dimolar adduct, and 276 wt. parts of terephthalic acid were charged into a reaction vessel equipped with a cooling pipe, a stirrer, and a nitrogen inlet tube; the contents of the reaction vessel were exposed to polycondensation under normal pressure at 230° C. for seven hours, and further exposed to reaction under a reduced pressure between 10 mmHg and 15 mmHg for five hours; and then a low-molecular-weight polyester 1 was obtained. Of the low molecular weight polyester 1, the number average molecular weight was 2,300, the weight average molecular weight was 6,700, the peak molecular weight was 3,800, the Tg was 43° C., and the acid value was four.

An intermediate polyester was synthesized as follows: 682 wt. parts of bisphenol A ethylene oxide dimolar adduct, 81 wt. parts of bisphenol A propylene oxide dimolar adduct, 283 wt. parts of terephthalic acid, 22 wt. parts of anhydrous trimellitic acid, and 2 wt. parts of dibutyl tin oxide were charged into a reaction vessel equipped with a cooling pipe, a stirrer, and a nitrogen inlet tube; the contents of the reaction vessel were exposed to reaction under normal pressure at 230° C. for seven hours, and further exposed to reaction under a reduced pressure between 10 mmHg and 15 mmHg for five hours; and then an intermediate polyester 1 was obtained. Of the intermediate polyester 1, the number average molecular weight was 2,200, the weight average molecular weight was 9,700, the peak molecular weight was 3,000, the Tg was 54° C., the acid value was 0.5, and the hydroxyl value was 52. In the next step, 410 wt. parts of the intermediate polyester 1, 89 wt. parts of isohorone diisocyanate, and 500 wt. parts of ethyl acetate, were charged into a reaction vessel equipped with a cooling pipe, a stirrer, and a nitrogen inlet tube, and exposed to reaction at 100° C. for five hours, and then a prepolymer 1 was obtained. The percent by weight of free isocyanate included in the prepolymer 1 was 1.53%.

A ketimine was synthesized as follows: 170 wt. parts of isohorone diamine and 75 wt. parts of methyl ethyl ketone were charged into a reaction vessel equipped with a stirrer and a thermometer; the contents of the reaction vessel were exposed to reaction at 50° C. for four and a half hours; and then a ketimine compound 1 was obtained. The amine value of the ketimine compound 1 was 417.

A masterbatch was synthesized as follows: 1,200 wt. parts of water, 540 wt. parts of carbon black (Printex 35, manufactured by Degussa AG) (dibutyl phthalate (DBP) oil absorption=42 ml/100 mg, pH=9.5), and 1,200 wt. parts of polyester resin were added and mixed in a Henschel mixer (manufactured by MITSUI MINING Co., Ltd.); the mixture was then kneaded at 130° C. for an hour by using two rollers, cooled by flatting, ground with a pulverizer; so that a masterbatch 1 was obtained.

An oil phase was prepared as follows: 378 wt. parts of the low-molecular-weight polyester 1, 100 wt. parts of carnauba wax, and 947 wt. parts of ethyl acetate were charged into a vessel equipped with a stirrer and a thermometer; and the contents of the vessel were heated to 80° C. while stirring, maintained at 80° C. for five hours, and then cooled to 30° C. in an hour.

In the next step, 500 wt. parts of the masterbatch 1 and 500 wt. parts of ethyl acetate were charged into a vessel, and mixed for an hour, as a result, a material solution 1 was obtained. In to another vessel, 1,324 wt. parts of the material solution 1 was poured, and carbon black and wax were dispersed by using a bead mill (Ultra Visco Mill, manufactured by AIMEX Co., Ltd.) under the following conditions: at liquid feed rate of 1 kg/hr, at disk circumferential velocity of 6 m/sec, with 0.5 millimeter zirconia beads filled to 80% by volume, and trough three passes. In the next step, 1,324 wt. parts of 65% ethyl acetate solution of the low-molecular-weight polyester 1 was added, and then dispersed through two passes by the bead mill under the conditions, as a result, a pigment-and-wax dispersion liquid 1 was obtained. The solids concentration of the pigment-and-wax dispersion liquid 1 was 50%.

The liquid was emulsified and a solvent was removed as follows: 749 wt. parts of the pigment-and-wax dispersion liquid 1, 115 wt. parts of the prepolymer 1, and 2.9 wt. parts of the ketimine compound 1 were charged into a vessel; the contents of the vessel were mixed at 5,000 rpm for two minutes by a TK homomixer (manufactured by TOKUSHU KIKA KOGYO Co., Ltd.); 1,200 wt. parts of the aqueous phase 1 was added into the vessel; and then the contents of the vessel were mixed by the TK homomixer at 13,000 rpm for 25 minutes; as a result, an emulsion slurry 1 was obtained.

The emulsion slurry 1 was charged into a vessel equipped with a stirrer and a thermometer, then the solvent was removed at 30° C. for seven hours, and the residue was matured at 45° C. for seven hours, as a result, a dispersion slurry 1 was obtained.

Rinsing and drying were carried out as follows. After 100 wt. parts of the dispersion slurry 1 was filtered under reduced pressure;

(1) the filter cake was added with 100 wt. parts of ion-exchanged water, mixed in the TK homomixer (at 12,000 rpm for 10 minutes), and then filtered;
(2) the filter cake obtained at the step (1) was added with 1% hydrochloric acid by controlling the pH between 3.5 and 4.5, and mixed in the TK homomixer (at 12,000 rpm for 15 minutes), and then filtered;
(3) a series of operations of adding 300 wt. parts of ion-exchanged water to the filter cake obtained at the step (2), mixing them in the TK homomixer (at 12,000 rpm for 10 minutes), and filtering the mixture, was repeated twice, as a result, a filter cake 1 was obtained; and
(4) the filter cake 1 was dried in an air-circulating dryer at 40° C. for 40 hours, and then sifted through a sieve with 75 micrometer mesh, as a result, toner base-particles 1 were obtained. After that, 1,100 wt. parts of the toner base-particles 1 was added with 1.5 wt. parts of hydrophobic silica and 0.5 wt. part of hydrophobized titanium oxide, and all of them were mixed in the Henschel mixer, and then sifted through a sieve with 35 micrometer mesh, as a result the toner 1 was obtained. Physical properties of the toner 1 are shown in the table 1.

TABLE 1

| | Toner particle diameter | | | | |
|---|---|---|---|---|---|
| | Volume particle diameter | Dv/Dn | Average circularity | Shape factor SF-1 | Shape factor SF-2 |
| Toner 1 | 3.5 | 1.34 | 0.998 | 105 | 102 |
| Toner 2 | 4.8 | 1.14 | 0.961 | 120 | 115 |
| Toner 3 | 2.4 | 1.14 | 0.985 | 141 | 135 |
| Toner 4 | 5.9 | 1.13 | 0.933 | 159 | 150 |
| Toner 5 | 5.5 | 1.22 | 0.921 | 170 | 180 |
| Toner 6 | 5.7 | 1.46 | 0.937 | 148 | 138 |
| Toner 7 | 7.2 | 1.22 | 0.975 | 176 | 160 |
| Toner 8 | 8.0 | 1.24 | 0.948 | 185 | 190 |

A toner 2 was produced similarly to the toner 1 except the following conditions changed as described below.

Physical properties of the toner 2 are shown in the table 1.

A resin microparticle emulsion was synthesized as follows: 683 wt. parts of water, 11 wt. parts of sodium salt of methacrylic acid ethylene oxide adduct sulfate (ELEMINOL RS-30, manufactured by Sanyo Chemical Industries, Ltd.), 83 wt. parts of styrene, 83 wt. parts of methacrylic acid, 110 wt. parts of butyl acrylate, and one part of ammonium persulfate were charged into a reaction vessel equipped with a stirrer and a thermometer; the contents of the vessel were stirred at 3,800 rpm for 30 minutes; as a result, a white emulsion was obtained. The temperature in the system was raised to 75° C. by heating up, and the obtained white emulsion was exposed to reaction for an hours. Furthermore, the reaction mixture was added with 30 wt. parts of 1% ammonium persulfate aqueous-solution, and then matured at 75° C. for six hours. As a result, a microparticle emulsion 2 was obtained, which was an aqueous dispersion liquid of a vinyl resin (a copolymer of styrene, methacrylic acid, butyl acrylate, and sodium salt of methacrylic acid ethylene oxide adduct sulfate). Diameters of particles in the microparticle emulsion 2 were measured by a laser scattering particle-size distribution analyzer (LA-920, manufactured by SYSMEX Corp.). It was 40 nanometers in volume average. Part of the microparticle emulsion 2 was dried, and the resin was isolated. The shape of a resin microparticle was spherical. The Tg of the resin was 56° C., and the weight average molecular weight was 120,000.

A toner 3 was produced similarly to the toner 1 except the following conditions changed as described below.

Physical properties of the toner 3 are shown in the table 1.

The liquid was emulsified and the solvent was removed as follows: 749 wt. parts of the pigment-and-wax dispersion liquid 1, 115 wt. parts of the prepolymer 1, and 2.9 wt. parts of the ketimine compound 1 were charged into a vessel; the contents of the vessel were mixed at 5,000 rpm for two minutes by the TK homomixer; 1,200 wt. parts of the aqueous phase 1 was added into the vessel; and then the contents of the vessel were mixed by the TK homomixer at 13,000 rpm for 10 minutes; as a result, an emulsion slurry 2 was obtained.

The emulsion slurry 2 was charged into a vessel equipped with a stirrer and a thermometer, then the solvent was removed at 30° C. for six hours, and the residue was matured at 45° C. for five hours, as a result, a dispersion slurry 2 was obtained.

The toner 4 was produced similarly to the toner 1 except the following conditions changed as described below.

Physical properties of the toner 4 are shown in the table 1.

The liquid was emulsified and the solvent was removed as follows: 749 wt. parts of the pigment-and-wax dispersion liquid 1, 115 wt. parts of the prepolymer 1, and 2.9 wt. parts of the ketimine compound 1 were charged into a vessel; the contents of the vessel were mixed at 5,000 rpm for two minutes by the TK homomixer; 1,200 wt. parts of the aqueous phase 1 was added into the vessel; and then the contents of the vessel were mixed by the TK homomixer at 13,000 rpm for 40 minutes; as a result, an emulsion slurry 3 was obtained.

The emulsion slurry 3 was charged into a vessel equipped with a stirrer and a thermometer, then the solvent was removed at 30° C. for eight hours, and the residue was matured at 45° C. for five hours, as a result, a dispersion slurry 3 was obtained.

A toner 5 was produced similarly to the toner 1 except the following conditions changed as described below.

Physical properties of the toner 5 are shown in the table 1.

An oil phase was prepared as follows: 378 wt. parts of the low-molecular-weight polyester 1, 130 wt. parts of carnauba-rice wax (weight ratio of five to five), and 947 wt. parts of ethyl acetate were charged into a vessel equipped with a stirrer and a thermometer, heated to 80° C. while stirring, maintained at 80° C. for four hours, and then cooled to 30° C. in an hour. In the next step, 500 wt. parts of the masterbatch 1 and 500 wt. parts of ethyl acetate were charged into a vessel, and mixed for two hours, as a result, a material solution 2 was obtained.

In to another vessel, 1,324 wt. parts of the material solution 2 was poured, and carbon black and wax were dispersed by using the bead mill under the following conditions: at liquid feed rate of 1 kg/hr, at disk circumferential velocity of 6 m/sec, with 0.5 millimeter zirconia beads filled to 80% by volume, and trough ten passes. In the next step, 1,324 wt. parts of 65% ethyl acetate solution of the low-molecular-weight polyester 1 was added, and then dispersed through five passes by the bead mill under the conditions, as a result, a pigment-and-wax dispersion liquid 2 was obtained.

The solids concentration of the pigment-and-wax dispersion liquid 2 was 50%.

The toner 6 was produced similarly to the toner 1 except the following conditions changed as described below.

Physical properties of the toner 6 are shown in the table 1.

An oil phase was prepared as follows: 378 wt. parts of the low-molecular-weight polyester 1, 100 wt. parts of carnauba-rice wax (weight ratio of three to seven), and 947 wt. parts of ethyl acetate were charged into a vessel equipped with a stirrer and a thermometer, heated to 80° C. while stirring, maintained at 80° C. for four hours, and then cooled to 30° C. in an hour. In the next step, 500 wt. parts of the masterbatch 1 and 500 wt. parts of ethyl acetate were charged into a vessel, and mixed for 0.8 hour, as a result, a material solution 3 was obtained.

In to another vessel, 1,324 wt. parts of the material solution 3 was poured, and carbon black and wax were dispersed by using a bead mill (Ultra Visco Mill, manufactured by AIMEX Co., Ltd.) under the following conditions: at liquid feed rate of 1 kg/hr, at disk circumferential velocity of 6 m/sec, with 0.5 millimeter zirconia beads filled to 80% by volume, and trough five passes. In the next step, 1,324 wt. parts of 65% ethyl acetate solution of the low-molecular-weight polyester 1 was added, and then dispersed through three passes by the bead mill under the conditions, as a result, a pigment-and-wax dispersion liquid 3 was obtained. The solids concentration of the pigment-and-wax dispersion liquid 3 was 50%.

The toner 7 was produced similarly to the toner 1 except the following conditions changed as described below.

Physical properties of the toner 7 are shown in the table 1.

A low-molecular-weight polyester was synthesized as follows: 229 wt. parts of bisphenol A ethylene oxide dimolar adduct, 529 wt. parts of bisphenol A propylene oxide trimolar adduct, 208 wt. parts of terephthalic acid, 46 wt. parts of adipic acid, and 2 wt. parts of dibutyl tin oxide were charged into a reaction vessel equipped with a cooling pipe, a stirrer, and a nitrogen inlet tube; the mixture were exposed to reaction under normal pressure at 230° C. for seven hours, and further exposed to reaction under a reduced pressure between 10 mmHg and 15 mmHg for five hours; subsequently 44 wt. parts of trimellitic anhydride was added into the reaction vessel, and the mixture was exposed to reaction at 180° C. under normal pressure for three hours; and then a low-molecular-weight polyester 2 was obtained. Of the low molecular weight polyester 2, the number average molecular weight was 2,300, the weight average molecular weight was 6,700, the peak molecular weight was 3,100, the Tg was 43° C., and the acid value was 25.

In a vessel equipped with a stirrer and a thermometer, 378 wt. parts of the low-molecular-weight polyester 2, 100 wt. parts of carnauba wax, and 947 wt. parts of ethyl acetate were charged, heated to 80° C. while stirring, maintained at 80° C. for five hours, and then cooled to 30° C. in an hour. In the next step, 500 wt. parts of the masterbatch 1 and 500 wt. parts of ethyl acetate were charged into a vessel, and mixed for an hour, as a result, a material solution 4 was obtained.

In to another vessel, 1,324 wt. parts of the material solution 4 was poured, and carbon black and wax were dispersed by using a bead mill (Ultra Visco Mill, manufactured by AIMEX Co., Ltd.) under the following conditions: at liquid feed rate of 1 kg/hr, at disk circumferential velocity of 6 m/sec, with 0.5 millimeter zirconia beads filled to 80% by volume, and trough three passes. In the next step, 1,324 wt. parts of 65% ethyl acetate solution of the low-molecular-weight polyester 2 was added, and then dispersed through three passes by the bead mill under the conditions, as a result, a pigment-and-wax dispersion liquid 4 was obtained. The solids concentration of the pigment-and-wax dispersion liquid 4 was 50%.

In a vessel, 749 wt. parts of the pigment-and-wax dispersion liquid 4, 115 wt. parts of the prepolymer 1, and 2.9 wt. parts of the ketimine compound 1 were charged, and mixed at 5,000 rpm for two minutes by a TK homomixer (manufactured by TOKUSHU KIKA KOGYO Co., Ltd.), then added with 1,200 wt. parts of the aqueous phase 1 into the vessel, and mixed by the TK homomixer at 13,000 rpm for 40 minutes, as a result, an emulsion slurry 4 was obtained.

The emulsion slurry 4 was charged into a vessel equipped with a stirrer and a thermometer, then the solvent was removed at 30° C. for eight hours, and the residue was matured at 45° C. for five hours, as a result, a dispersion slurry 4 was obtained.

A toner 8 was produced similarly to the toner 1 except the following conditions changed as described below.

Physical properties of the toner 8 are shown in the table 1.

Into a vessel equipped with a stirrer and a thermometer, 378 wt. parts of the low-molecular-weight polyester 1, 380 wt. parts of carnauba wax, and 947 wt. parts of ethyl acetate were charged, heated to 80° C. while stirring, maintained at 80° C. for five hours, and then cooled to 30° C. in four hours. In the next step, 500 wt. parts of the masterbatch 1 and 500 wt. parts of ethyl acetate were charged into a vessel, and mixed for two hours, as a result, a material solution 5 was obtained.

Into another vessel, 1,324 wt. parts of the material solution 5 was poured, and carbon black and wax were dispersed by using a bead mill (Ultra Visco Mill, manufactured by AIMEX Co., Ltd.) under the following conditions: at liquid feed rate of 1 kg/hr, at disk circumferential velocity of 6 m/sec, with 0.5 millimeter zirconia beads filled to 80% by volume, and trough seven passes. In the next step, 1,324 wt. parts of 65% ethyl acetate solution of the low-molecular-weight polyester 1 was added, and then dispersed through four passes by the bead mill under the conditions, as a result, a pigment-and-wax dispersion liquid 5 was obtained. The solids concentration of the pigment-and-wax dispersion liquid 5 was 50%.

After each of the toners in the examples was prepared as a developer, the toner was charged into the printer 100 according to the first embodiment, and then comparative experiments between the cleaning device 30 according to the first embodiment and the conventional apparatus were carried out by performing the following initial running tests.

In this case, the conventional apparatus was the cleaning device of the counter type shown in FIG. 17B. The blade material was made from polyurethane rubber at 70 degrees JIS A-hardness. The blade had dimensions of T1 is 2.0 millimeters, and T3 is 326 millimeters, and a rectangular parallelepiped shape. The blade was bonded to the blade holder with a double-sided tape. The blade length extending to the photoconductor surface from the blade holder (free length L) was 7.6 millimeters. The contact angle θ was set to 21.6 degrees, and the amount of bite was 1.0 millimeter. The linear pressure was 0.788 N/cm. An organic photoconductor was used as the photoconductor 10.

The running tests were carried out by the printer 100, by replacing only the cleaning device 30 with the conventional apparatus. In the running tests, a pattern on A4 size at an image area rate of 5% was continuously printed, and a removal performance (cleaning performance) was evaluated at the starting time, the 5,000th sheet, and the 10,000th sheet. However, when a toner was visually evaluated as poor in the total evaluation, the initial running test for the toner is terminated.

When evaluating cleaning performance; after a pattern at an image area rate of 75% was continuously printed for 100 sheets, toner remaining on the photoconductor after going through the cleaning device was transferred with Printac C Tape (manufactured by NITTO DENKO Co., Ltd.); and the tape was stuck on white paper, and measured by Macbeth reflection densitometer RD514. The results were evaluated as follows: a difference from the blank density less than 0.005 was "excellent", a difference between 0.005 and 0.010 was "good", a difference between 0.011 and 0.02 was "passable", and a difference more than 0.02 was "poor".

The visual total evaluation was performed as follows:

Excellent: Capable in practical use. No abnormal noise, such as flapping. No toner particle passing through. Even if there were some, those were not able to be observed by a method of transferring dirt onto a tape and determining a degree of dirt on the tape stuck on white paper with naked eyes.

Good: Adequate for practical use. No abnormal noise. No stripe, or only thin stripes. Passing through toner particles were observed.

Passable: There was a possibility of rejection in practical use. Some indication of abnormal noise. There were one to ten stripes less than one millimeter in width on an image of A4 landscape size.

Poor: Incapable in practical use. Abnormal noise and signs of damage on the photoconductor were observed. There were strips across the whole surface.

The results of the running tests are as shown in the following table 2.

TABLE 2

| | | Cleaning performance evaluation | | | Total Evaluation (Visual) | | |
|---|---|---|---|---|---|---|---|
| | | Start | 5,000th sheet | 10,000th sheet | Start | 5,000th sheet | 10,000th sheet |
| Toner 1 | Conventional apparatus | Poor | — | — | Poor | — | — |
| | Embodiment apparatus | Excellent | Excellent | Excellent | Excellent | Excellent | Excellent |
| Toner 2 | Conventional apparatus | Good | Passable | Poor | Passable | Passable | Poor |
| | Embodiment apparatus | Excellent | Excellent | Excellent | Excellent | Excellent | Excellent |
| Toner 3 | Conventional apparatus | Poor | — | — | Poor | — | — |
| | Embodiment apparatus | Excellent | Excellent | Good | Excellent | Good | Good |
| Toner 4 | Conventional apparatus | Excellent | Excellent | Excellent | Excellent | Excellent | Excellent |
| | Embodiment apparatus | Excellent | Excellent | Excellent | Excellent | Excellent | Excellent |
| Toner 5 | Conventional apparatus | Excellent | Excellent | Excellent | Excellent | Excellent | Excellent |
| | Embodiment apparatus | Excellent | Excellent | Excellent | Excellent | Excellent | Excellent |
| Toner 6 | Conventional apparatus | Excellent | Excellent | Excellent | Excellent | Excellent | Excellent |
| | Embodiment apparatus | Excellent | Excellent | Excellent | Excellent | Excellent | Excellent |
| Toner 7 | Conventional apparatus | Passable | Poor | — | Passable | Poor | — |
| | Embodiment apparatus | Excellent | Excellent | Excellent | Excellent | Excellent | Excellent |
| Toner 8 | Conventional apparatus | Excellent | Excellent | Excellent | Excellent | Excellent | Excellent |
| | Embodiment apparatus | Excellent | Excellent | Excellent | Excellent | Excellent | Excellent |

The conventional apparatus had a poorer cleaning performance for a toner having the particle diameter of three micrometers or less, or a toner having the average circularity of 0.96 or higher. Particularly, where the average circularity was up to 0.96, and the toner diameter was approximately six micrometers, there was a large difference in the cleaning performances. Although there was no abnormal noise from the blade, and no sign of damage on the photoconductor, strips were observed. Therefore, it was predicted that if the running test was further extended, wear on the blade and the photoconductor would occur.

By contrast, in a case where the cleaning device 30 is used, there was no sign of deterioration of the cleaning performance, abnormal noise from the blade, and damage on the photoconductor, using any toner. However, when using the toner 3, a phenomenon of passing through of toner particles was observed, although the cleaning performance is still better than that by the conventional apparatus. Not obvious strip, but a sign of strips was observed, so that it was predicted that if a toner particle diameter was approximately three micrometers or less, substantial effect would not be expected even to the cleaning device 30. Combinations with further toner characteristics, such as distribution of particle diameters, and variations of physical properties, would be required.

The running tests were carried out in a process of the initial running test, to compare differences in physical properties of toners. There is a further possibility that further differences will be revealed by carrying out a long-term deterioration mode or a running mode added with environmental variations.

The cleaning device 30 according to the first embodiment can make the contact width short, while maintaining the contact pressure as high as that in the cleaning device of the conventional counter type, thereby reducing wear on the photoconductor 10 and the blade 31. Flapping of the blade 31 hardly occur easily.

The cleaning device 30 according to the modification can reduce wear on the blade 31 further effectively. According to the first embodiment, the blade 31 has no free length part, so that warp in the blade 31 can be effectively restricted.

According to the first embodiment, because the horizontal portion 32A of the blade holder 32 is bonded to the whole of the opposed surface of the upstream side surface 31*a* of the blade 31, adhesion between the horizontal portion 32A of the blade holder 32 and the blade 31 is firm, thereby preventing the blade from flapping effectively.

As bonding is performed at least on a marginal area close to the surface of the photoconductor 10 from across an overlapping area where the horizontal portion 32A and the opposed surface of the upstream side surface 31*a* overlap one another, flapping of the blade 31 can be prevented effectively.

Because of the springs 36 provided as a force assistance, even if a distance relation between the frame 33 and the surface of the photoconductor 10 is changed, for example, due to eccentricity of the photoconductor 10, the blade holder 32 can be displaced in accordance with the change, so that a high precision is required neither for the distance relation between the frame 33 and the surface of the photoconductor 10, nor for assembling the blade 31 to the photoconductor 10.

According to the first embodiment, the blade 31 is configured to have the contact angle θ between 5 degrees and 50 degrees, thereby achieving a sufficient removal performance (cleaning performance) easily.

Although the cleaning device 30 for a photoconductor is explained above in the first embodiment, the first embodiment can be applied to a cleaning device for a surface moving member in any image forming apparatus, as well as the printer 100. For example, the first embodiment can be applied to a monochrome image forming apparatus, and an image forming apparatus that includes a photoconductor and a plurality of developing devices (for example, for four colors), toner images of the respective colors are produced by rotating the developing devices, and then an image is formed finally by transferring the toner images onto transfer paper. Not only for a printer, the first embodiment can be used as a cleaning device for a photocopier, a facsimile, or a multifunctional peripheral having a plurality of functions. Regardless of an electrophotography type, an ink jet type, or another type, as long as an image forming apparatus includes a surface moving member and requires to remove deposit remaining on the surface of the surface moving member, the first embodiment can be applied to the image forming apparatus. Deposit to be removed can be toner, paper powder, metal powder, and any other powdery substance, and even a liquid, such as a developer, so that the first embodiment can be similarly applied.

In addition to the cleaning device for the photoconductor, the first embodiment can be applied to a cleaning device for removing deposit, such as residual toner, reaming on the surface on a surface moving member other than the photoconductor, e.g., the intermediate transfer belt 162. Moreover, the first embodiment can be applied to a cleaning device for removing deposit, such as toner or paper powder, attached on a recording material conveyor member that supports and conveys a recording material on its surface. The first embodiment can be applied to a cleaning device for any surface moving member that requires to remove deposit attached on its surface. The surface moving member can be drum, a belt, or in any other shape, of which member surface moves. When the cleaning device is used for the surface moving member of a belt, generally the cleaning device is arranged to catch the belt between the blade and a supporting roller that supports the belt. However, a backup member, such as a flat plate member, can be arranged on the internal side of the belt, and the cleaning device can be arranged to catch the belt between the blade and the backup member. When a target to be cleaned is the photoconductor 10, the cleaning device according to the first embodiment can be applied for any photoconductor, which can be an organic photoconductor, an amorphous silicon photoconductor, or a photoconductor of which a protective layer made from a binder resin having a crosslinked structure is provided on an organic photoconductor surface. When a target to be cleaned is the intermediate transfer belt 162, the cleaning device according to the first embodiment can be applied for any intermediate transfer belt, which can be an intermediate transfer belt made form polyimides considering heat resistance and strechability, an intermediate transfer belt using polyethylene materials, or an intermediate transfer belt made of fluoric materials and rubber materials.

In the various applications explained above, the configuration of the cleaning device 30 for a photoconductor explained in the first embodiment can be used without substantial change, or a configuration that is appropriately modified in accordance with each of the application can be used.

Another cleaning device according to a second embodiment of the present invention, which is different from the cleaning device described above, is explained below.

Figure 9:
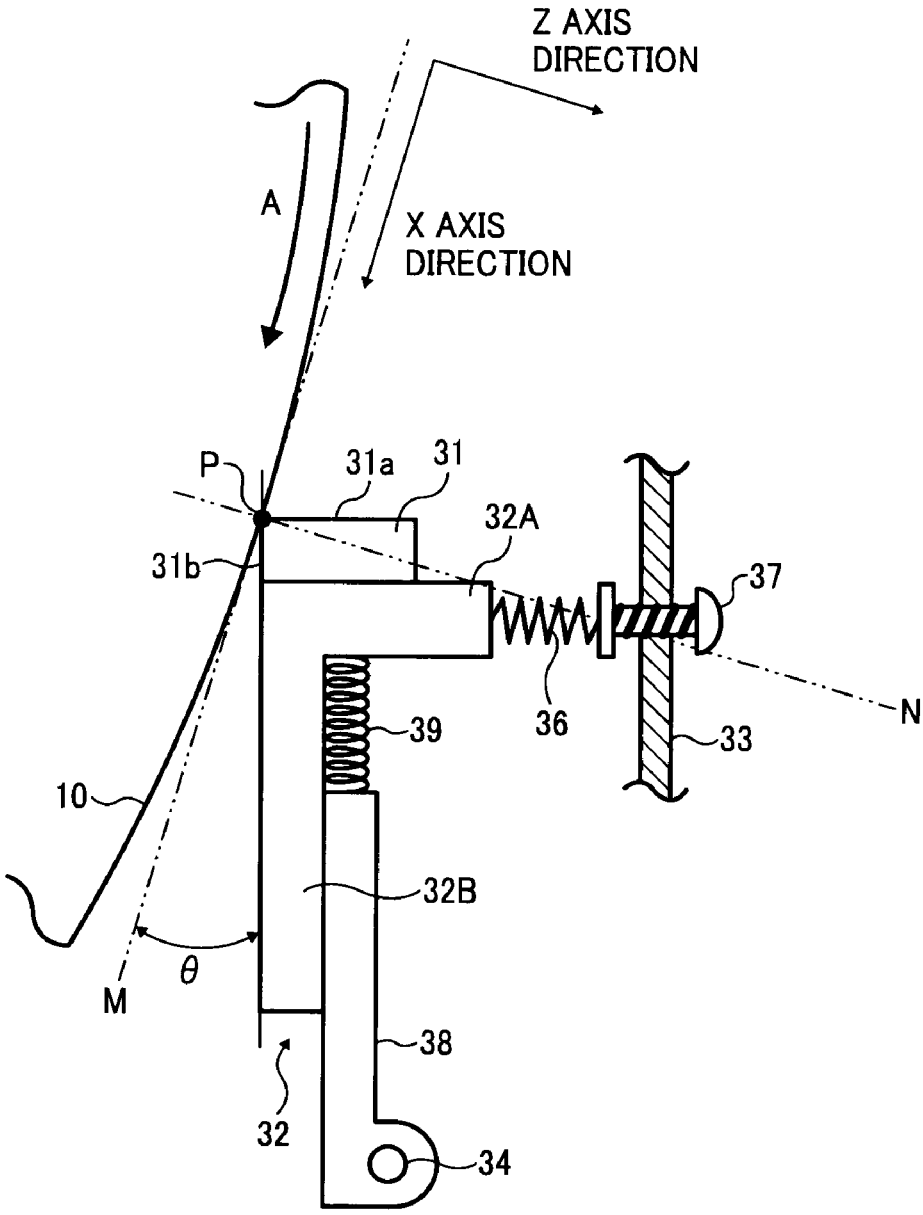
FIG. 9 is a schematic diagram for explaining of relevant parts of a cleaning device for a printer, viewed from the photoconductor rotation axis direction, according to a second embodiment of the present invention.

FIG. 9 is a schematic diagram for explaining relevant parts of the cleaning device 30 viewed from the rotation axis direction (y axis direction) of the photoconductor 10 according to the second embodiment.

Figure 10:
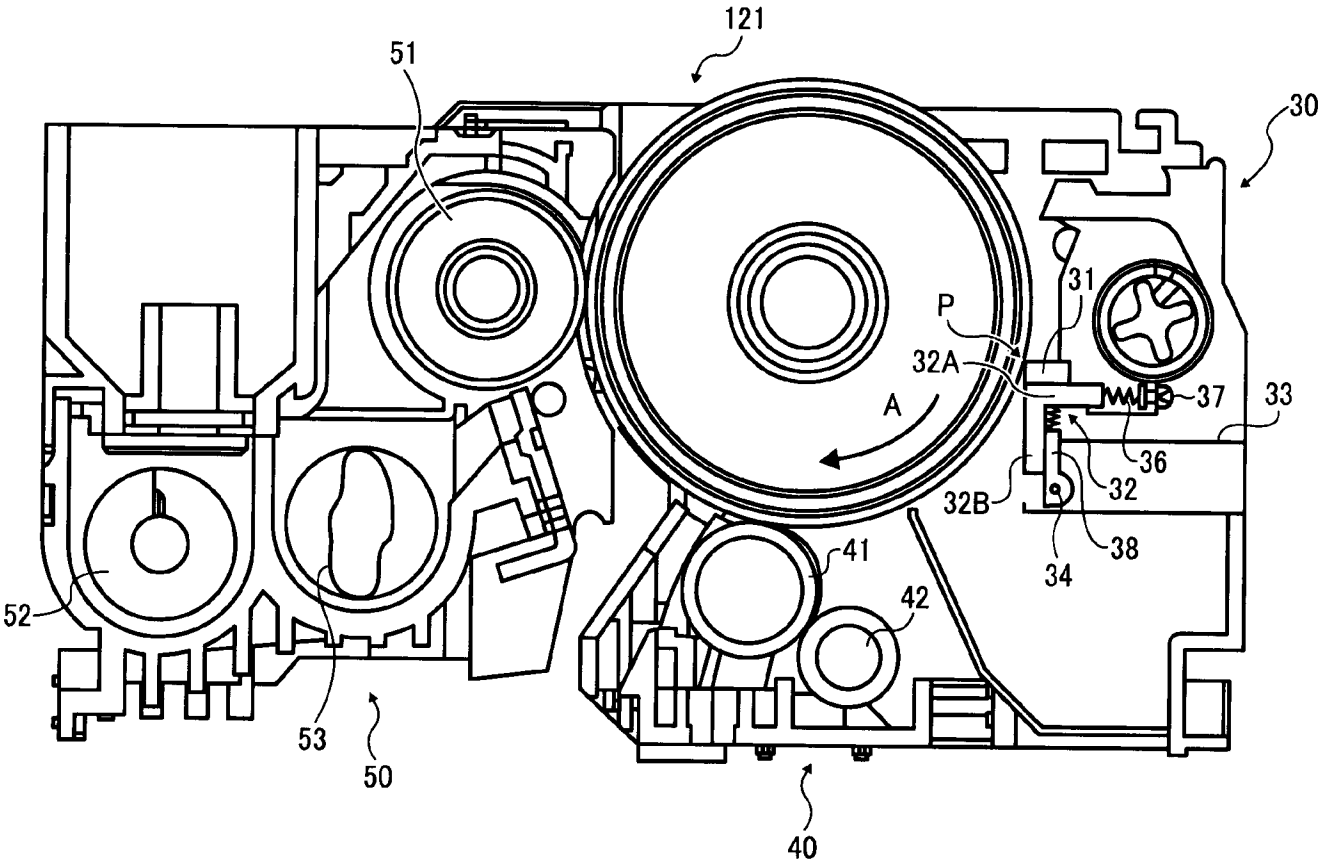
FIG. 10 is a schematic diagram for explaining an outline configuration of a process cartridge to be provided in the printer according to the second embodiment.

FIG. 10 is a schematic diagram for explaining an outline configuration of a process cartridge according to the second embodiment to be provided in the printer shown in FIG. 2.

Configurations of a plurality of the process cartridges to be arranged for forming an image are substantially similar to one another, so that a configuration and an operation of one of the process cartridges is explained in the following explanation without attached characters Y, C, M, and Bk for distinguishing between the process cartridges in terms of color.

The process cartridge 121 includes the photoconductor 10, and the cleaning device 30, the electric charger 40, and the developing device 50, three of which are arranged around the photoconductor 10.

The cleaning device 30 includes the blade 31 that is an elastic member used longitudinally extending along the rotation axis direction of the photoconductor 10. The cleaning device 30 removes unwanted deposit, such as transfer residual toner on a photoconductor surface, by pressing a longitudinally extending edge (contact edge) of the blade 31 onto the surface of the photoconductor 10. According to the second embodiment, polyurethane rubber is used as a material of the blade 31, because polyurethane rubber has more excellent characteristics for wear properties of the photoconductor 10 and in wear resistance of the blade 31 itself than other elastic materials. The cleaning device 30 will be explained in detail later.

A lubricant applicator can be provided in the cleaning device 30. Particularly in the second embodiment, using a so-called spherical toner, the blade 31 needs to clean the spherical toner, so that the blade 31 is pressed to contact with the photoconductor 10 by applying a high load. For this reason, blade wear and coat scrape on the photoconductor 10 are increased. By applying lubricant over the surface of the photoconductor 10, wear on the blade 31 and coat scrape on the photoconductor 10 can be reduced. When the photoconductor 10 is electrostatically charged by the electric charger 40, which uses an electrostatic discharge as described later, the photoconductor surface is gradually reformed due to the electrostatic discharge, and a surface energy is increased. In such case, a cleaning failure occurs more often. However, by applying lubricant, reforming of the photoconductor surface is suppressed, so that the quality of cleaning spherical toner can be maintained over the elapse of time.

As the lubricant applicator, a device that includes a solid lubricant, a lubricant supporting member for supporting the solid lubricant, and a brush roller for applying the lubricant by rotating in contact with both the solid lubricant and the photoconductor 10, can be used. Such lubricant applicator applies powdery lubricant with the brush roller scraped by the brush roller from the solid lubricant onto the surface of the photoconductor 10. Alternatively, a spreading member can be arranged downstream of the brush roller in the photoconductor-surface moving direction to be in contact with the surface of the photoconductor 10. The spreading member is supported by keeping the tip of the spreading member in contact with the surface of the photoconductor 10, for making uniform the thickness of lubricant applied on the photoconductor 10. As the spreading member, an elastic solid, such as a urethane rubber blade, or an elastic roller is made in contact with the photoconductor 10 at an appropriate pressure. In another example of the lubricant applicator, a pocket for powdery lubricant is arranged on the opposite side of the surface of the photoconductor 10, and the powdery lubricant is fed onto the surface of the photoconductor 10.

Although an application position of the lubricant can be arranged upstream of the contact point of the blade 31 in the surface moving direction of the photoconductor 10, the lubricant may be removed together with toner that is removed by the blade 31, so that there is a possibility that a coat of the lubricant may not be uniformly formed over the photoconductor surface. For this reason, the application position of the lubricant is preferably arranged downstream of the contact point of the blade 31 and upstream of the electric charger 40. In such case, the lubricant can be applied uniformly, because the lubricant is to be applied on the photoconductor surface from which toner has been removed.

As the lubricant, a lamella crystal powder, such as zinc stearate can be preferably used. Lamella crystals have a layer structure of self-organization of amphipathic molecules, so that the lamella crystals are easily broken along interlamellar boundaries when a shearing force is applied, and easily turn to lubricate a surface. It is considered that the action is effective on lowering a friction coefficient. Other materials, such as fatty acid salts, waxes, silicone oils, can also be used as the lubricant. Specific examples of the fatty acids include undecylic acid, lauric acid, tridecylic acid, myristic acid, palmitic acid, pentadecylic acid, stearic acid, heptadecylic acid, arachic acid, montanic acid, oleic acid, arachidonic acid, caprylic acid, capric acid, and caproic acid. Specific examples of metals of metallic salts for the fatty acids include zinc, iron, copper, magnesium, aluminum, and calcium.

The electric charger 40 includes the charging roller 41 arranged to come in contact with the photoconductor 10, and the charging roller cleaner 42 rotates in contact with the charging roller 41.

The developing device 50 is configured to produce a visible image from an electrostatic latent image by feeding toner onto the surface of the photoconductor 10, and includes the developing roller 51, the stirring screw 52, and the feeding screw 53. The developing roller 51 is a developer bearing member that bears a developer on its surface. The stirring screw 52 stirs a developer contained in a developer container unit. The feeding screw 53 feeds the stirred developer onto the developing roller 51.

Each of the four of the process cartridges 121 configured as described above can be individually demounted and replaced by a service person or a user. In the process cartridge 121 demounted from the printer 100, any of the photoconductor 10, the electric charger 40, the developing device 50, and the cleaning device 30 can be individually replaced with a new one. The process cartridge 121 can include a used toner tank that collects transfer residual toner collected by the cleaning device 30. In such case, if the process cartridge 121 includes the used toner tank in a configuration such that the used toner tank can be individually demounted and replaced, the convenience is enhanced.

Figure 11:
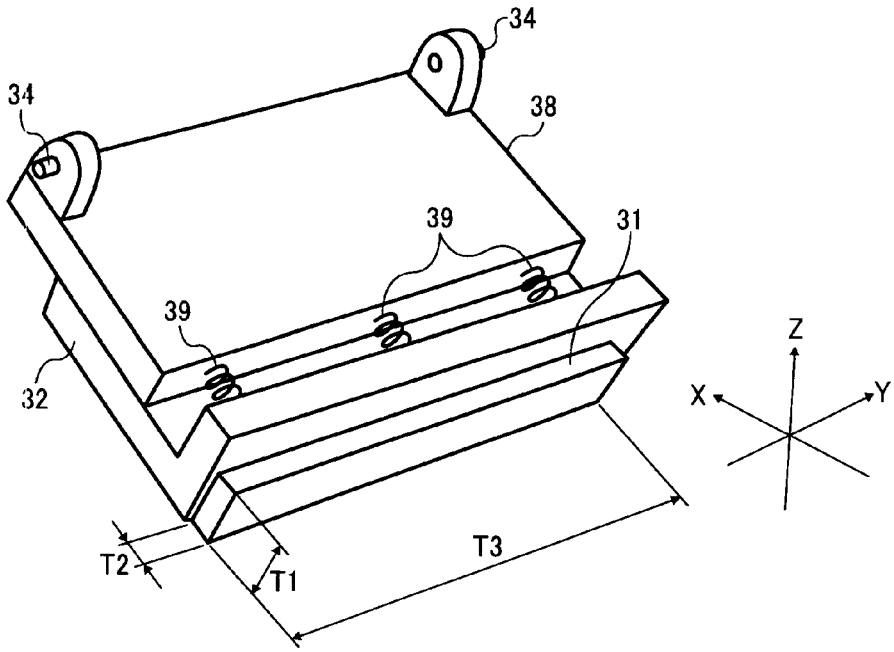
FIG. 11 is a perspective view of relevant parts of the cleaning device shown in FIG. 9.

FIG. 11 is a perspective view of relevant parts of the cleaning device 30 according to the second embodiment.

In the second embodiment, the cleaning device 30 includes the blade holder 32 that holds the blade 31, and is made of a rigid material. The blade holder 32 has a substantially L-shaped cross section that is cut orthogonally to the rotation axis of the photoconductor 10. The blade 31 is bonded on the upper surface of the horizontal portion 32A of the blade holder 32, where the horizontal portion 32A is a portion extending along a substantially horizontal direction in FIG. 3, and the upper surface is a surface facing upstream in the photoconductor-surface moving direction). A method of bonding can be adhesive bonding, hot melt, or the like. According to the second embodiment, the horizontal portion 32A functions as a warp restrictive member to restrict a warp in the blade 3.

The blade holder 32 includes the vertical portion 32B, which vertically extends in FIG. 10. A bottom side (portion downstream in the photoconductor-surface moving direction) of the vertical portion 32B is supported by a blade bracket 38 to be slidable in the substantially vertical direction.

A bottom end of the blade bracket 38 (extremity downstream in the photoconductor-surface moving direction) is pivotally supported by the shaft 34 provided on the frame 33 of the cleaning device 30. According to the second embodiment, the blade 31 is held via the horizontal portion 32A with the vertical portion 32B of the blade holder 32 and the blade bracket 38, which is supported downstream of a normal line N in the photoconductor-surface moving direction by the shaft 34 on the frame 33 of the cleaning device 30, that is, supported by the main body of the cleaning device 30, where the normal line N is normal to the contact pint P on the surface of the photoconductor 10 in contact with the contact edge of the blade 31. In other words, the cleaning device 30 is a counter type, and the vertical portion 32B of the blade holder 32 and the blade bracket 38 function as a holding mechanism.

Compression springs 39 are arranged as an elastic-force applying unit between the upper end of the blade bracket 38 (end portion upstream in the photoconductor-surface moving direction) and the horizontal portion 32A. Between the upper end of the blade bracket 38 and the horizontal portion 32A, a force works in directions to separate each other by the elastic force of the compression springs 39. As the bottom end of the blade bracket 38 is supported by the shaft 34 on the frame 33, the blade bracket 38 is configured not to be vertically displaced. Thus, the horizontal portion 32A of the blade holder 32 is vertically assisted with the elastic force of the compression springs 39. With the elastic force, the blade 31 can come in contact with the surface of the photoconductor 10 from an angle θ (hereinafter "contact angle") of approximately 15 degrees formed between an upstream side part in the photoconductor-surface moving direction of the downstream side surface 31*b* and a downstream side part in the surface moving direction of the tangent line M to the contact point P on the surface of the photoconductor 10 when the blade 31 is not pressed on the surface of the photoconductor 10, as shown in FIG. 9. The contact angle θ is appropriately set within a range between 5 degrees and 50 degrees. It is difficult to set the contact angle θ to less than 5 degree due to the layout around the photoconductor 10. If the contact angle θ is set to more than 50 degrees, a possibility that a sufficient removal performance may not be obtained is increased. More preferably, the contact angle θ is set within a range between 7 degrees and 40 degrees.

As shown in FIG. 11, to apply the elastic force onto a plurality of points, three points positioned differently from each other along the longitudinal direction of the blade 31 according to the second embodiment, three of the compression springs 39 are provided. Accordingly, even if the elastic force of each of the compression springs 39 is relatively small, a sufficient elastic force can be obtained.

In addition, the cleaning device 30 includes the springs 36 as a force assistance unit, which enhances a pressing force applied by the blade 31 in the direction of the normal line N to the contact point P on the surface of the photoconductor 10. According to the second embodiment, two of the springs 36 are provided, each of which is arranged at a distance of 110 millimeters from the center in the longitudinal direction of the blade 31 (the photoconductor rotation-axis direction) towards a longitudinal end. An end of the spring 36 is connected to an end of the horizontal portion 32A, the other end of the spring 36 is connected to the adjustive screw 37, which is an elastic-force adjustment unit. The adjustive screw 37 is engaged in a screw hole arranged in the frame 33 of the cleaning device 30. When adjusting the pressing force by using the adjustive screw 37, an adjusting stick is inserted through a notched hole from the outside of the frame 33 of the cleaning device 30, and the length of the spring 36 is adjusted by turning the adjustive screw 37 with the adjusting stick.

Adjustment of the pressing force of the blade 31 to the surface of the photoconductor 10 is explained below.

Figure 12:
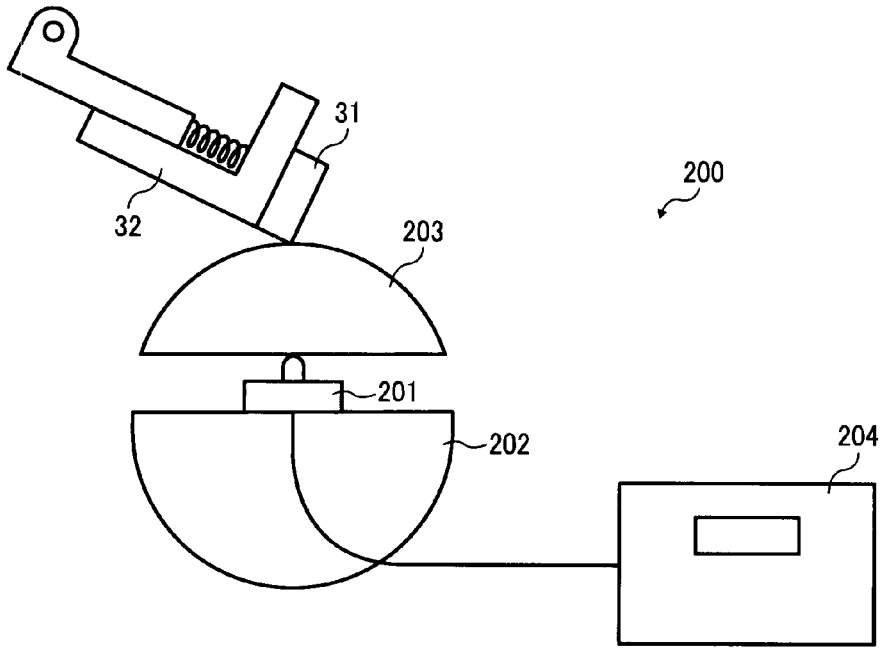
FIG. 12 is a schematic diagram for explaining a measuring device for a pressing force of a blade to be provided in the cleaning device shown in FIG. 11.

FIG. 12 is a schematic diagram for explaining the measuring device 200 for a pressing force of the blade 31. In practice, the measuring device 200 can be a commercially available conditioner for sensor, WGA-710B (manufactured by KYOWA DENGYO Co., Ltd.), and a load cell, LMA-A-2-N (manufactured by KYOWA DENGYO Co., Ltd.), which can be used in combination with the conditioner. The measuring device 200 includes three of the load cells 201. The load cells 201 are fastened on the cell mount 202, which is in a semi-cylindrical shape, at three points in total: one is at the center in the longitudinal direction of the blade 31; and the other two in a distance of 140 millimeters from the center towards respective longitudinal ends. The jigs 203 are placed on the load cells 201. The jigs 203 have a curved surface having the same curvature radius as the photoconductor 10. The jigs 203 are arranged three in line along the longitudinal direction of the blade 31, each of the load cells 201 is set at the center of the bottom surface of each of the jigs 203.

The blade 31 is set on the measuring device 200 such that a positional relation with the jigs 203 is to be the same as that with the photoconductor 10.

When adjusting the pressing force of the blade 31 by using the measuring device 200, the measuring device 200, instead of the photoconductor 10, is mounted onto the process cartridge 121 in a state where the cleaning device 30 is assembled in the printer 100. Specifically, by using a supporting unit to support a driving shaft of the photoconductor 10, the cell mount 202 on which three of the load cells 201 are fastened, and three of the jigs 203 are mounted on the process cartridge 121. When mounting, the cell mount 202 and the jigs 203 are set such that a virtual line between the contact edge of the blade 31 and each of the load cells 201 is to become perpendicular to the bottom surface of each of the jigs 203. A load applied via each of the jigs 203 is then detected by each of the load cells 201, and the pressing force of the blade 31 is adjusted by regulating the adjustive screw 37, while watching a value displayed on the sensor conditioner 204 connected to the measuring device 200.

When measuring, a predetermined weight needs to be placed on each of the jigs 203 in advance, and the adjustive screws 37 has to be set in such a manner that each value displayed on the sensor conditioner 204 is to be the same, and the value displayed on the sensor conditioner 204 is to be such a value that a load applied by the jig 203 is cancelled.

When adjusting a load balance to make the pressing force of the blade 31 uniform in the longitudinal direction of the blade 31, according to the second embodiment, the load balance is adjusted by turning the adjustive screws 37 such that differentials of values of the load cells 201 displayed on the sensor conditioner 204 are to fall within a margin of plus or minus 10 grams.

When adjusting the pressing force of the blade 31, it is fundamentally necessary to adjust the contact pressure between the blade 31 and the surface of the photoconductor 10 to be a target value. However, a contact width (nip width) between the blade 31 and the surface of the photoconductor 10 is difficult to measure. Therefore, the pressing force is generally adjusted in such a manner that a linear pressure is to be a target value. The linear pressure means a pressure applied on a contact point between the blade 31 and the surface of the photoconductor 10 per unit length in the photoconductor rotation-axis direction. Specifically, a linear pressure (N/cm) is a value obtained by dividing the total load of summing values of the load cells 201 displayed on the sensor conditioner 204 by a length T3 of the blade 31 in the longitudinal direction.

As a warp in the blade 31 is the larger, the contact width between the blade 31 and the surface of the photoconductor 10 is the longer, and moreover, as a deformation in the blade 31 is the larger, the contact width is the longer. In the cleaning device 30 according to the second embodiment, a warp in the blade 31 is restricted with the horizontal portion 32A as described above, so that the warp in the blade 31 hardly occurs. Consequently, the warp can be ignored when comparing with a warp in a blade of the cleaning device of the conventional counter type shown in FIG. 17B. Therefore, in the cleaning device 30 according to the second embodiment, the contact width mainly only depends on elastic deformation (compressive deformation) of the blade 31 in the photoconductor-surface moving direction. Thus, the cleaning device 30 according to the second embodiment can make the contact width shorter than that in the cleaning device of the conventional counter type shown in FIG. 17B. Accordingly, even if pressing the blade 31 with a linear pressure as high as that applied by the cleaning device of the conventional counter type, a contact pressure generated by the linear pressure is higher than that in the cleaning device of the conventional counter type. Conversely, to obtain a contact pressure as high as that in the cleaning device of the conventional counter type, the cleaning device 30 requires a smaller pressing force of the blade 31 than the cleaning device of the conventional counter type. The contact width in the second embodiment is expected to be substantially shorter than that in the cleaning device of the conventional counter type. Based on the expectation, it is conceivable that a substantially lower linear pressure than that generated in the cleaning device of the conventional counter type can achieve a contact pressure as high as that in the cleaning device of the conventional counter, and the similar removal performance.

The force assistance unit, such as the springs 36, is not necessarily to be provided, so that the end of the horizontal portion 32A can be connected to the frame 33 without such force assistance unit. However, in such case, when the vertical portion 32B of the blade holder 32 slides relatively to the blade bracket 38, the end of the horizontal portion 32A of the blade holder 32 needs to be displaced to the sliding direction in relation to the frame 33.

In the second embodiment, the elastic force generated by three of the compression springs 39 that form the elastic-force applying unit is preferably set to an elastic force as high as the compression springs 39 can contract, when a friction force smaller than the maximum static friction force is generated between the blade 31 and the surface of the photoconductor 10. Accordingly, when the blade 31 receives a large force towards the shaft 34 due to the maximum static friction force generated between the blade 31 and the surface of the photoconductor 10 during the period of starting operation of the photoconductor 10, the compression springs 39 contract, the blade 31 slides together with the blade holder 32 relatively to the blade bracket 38, and the blade 31 can be displaced towards the direction away from the surface of the photoconductor 10. Consequently, in the period of starting operation of the photoconductor 10, during which the contact pressure between the blade 31 and the surface of the photoconductor 10 tends to increase excessively, the contact pressure can be released, and excessive increase in the contact pressure can be suppressed.

The elastic force generated by three of the compression springs 39 is preferably set in such a manner that the maximum displacement of the blade 31 when receiving from the photoconductor 10 a force towards downstream in the photoconductor-surface moving direction is to be less than or equal to five millimeters. If the blade 31 is configured to be displaced substantially largely, there is a possibility that the contact angle θ of the blade 31 can be widened beyond a predetermined range. If the contact angle θ of the blade 31 is widened and becomes too large beyond a predetermined range, the regular contact pressure is increased. As a result, there is a possibility that the surface of the photoconductor 10 may be worn heavily, or the regular operational load onto the photoconductor 10 is increased.

However, even if the elastic force generated by three of the compression springs 39 is set in such a manner that the maximum displacement of the blade 31 is to be less than or equal to five millimeters, it is conceivable that the blade 31 is displaced by beyond five millimeters due to an unexpected sudden increase in the friction force. If the blade 31 is displaced to the direction that the compression springs 39 contract, the blade 31 turns around the shaft 34 with assistant force applied by the springs 36, and the contact point P on the photoconductor surface shifts downstream in the photoconductor-surface moving direction. If the amount of displacement of the blade 31 is small, the contact point P can return to the initial point with the elastic force of the compression springs 39. However, if the amount of displacement of the blade 31 is large, there is a possibility that the contact point P cannot return to the initial point only with the elastic force of the compression springs 39. The reason for this is because as the amount of displacement of the blade 31 is the larger, the amount of shifting the contact point P on the photoconductor surface in the photoconductor-surface moving direction is the larger. Accordingly, the contact angle θ is increased, and a force component in the direction of the normal to the contact point P in the elastic force of the compression springs 39 is increased, thus increasing the friction force.

Therefore, a displacement restrictive unit is preferably provided, which restricts an upper limit of the displacement amount of the cleaning device 30 when receiving a force towards downstream in the photoconductor-surface moving direction from the photoconductor 10, in order to ensure that the contact edge can return to the initial point, even if an unexpected sudden increase in the friction force occurs. For example, a stopper provided on the frame 33 to be in contact with the horizontal portion 32A of the blade holder 32 can be the displacement restrictive unit.

In the second embodiment, the blade 31 is in the shape of a rectangular parallelepiped longitudinally extending in the photoconductor rotation-axis direction (y axis direction). Lengths T1 and T2 (see FIG. 11) of two surfaces, i.e., the upstream side surface 31*a* and the downstream side surface 31*b*, respectively, are lengths orthogonal to the contact edge on the two surfaces 31*a* and 31*b*, which adjoin each other with respect to the contact edge as shown in FIG. 9. The length T2 is formed longer than the length T1. Instead of such rectangular parallelepiped, the blade 31 can take any three-dimensional shape that has the two surfaces 31*a* and 31*b* adjoining each other with respect to the contact edge, and allows the blade 31 to satisfactorily remove deposit on the photoconductor surface along the photoconductor rotation-axis direction. Each of the outer surfaces of the blade 31 is not necessarily flat, but can also be curved.

The shorter length of the blade 31 along a direction of compressive deformation caused by moving the surface of the photoconductor 10 results in the smaller extent of elastic deformation due to the compressive deformation. A length of the blade 31 in the compression direction is approximately equivalent to the length T2 of the downstream side surface 31*b* in the photoconductor-surface moving direction. In FIG. 17B, when measuring a length of each surface of the cleaning blade 231 in a direction orthogonal to the contact edge on a corresponding surface, a length T1 is a length of an upstream side surface 231*a*, and a length T2 is a length of the downstream side surface 231*b*. Comparing the length T2 according to the second embodiment with the length T2 in the cleaning device of the conventional counter type shown in FIG. 17B, the former is much shorter than the latter. Consequently, at least comparing the extents of elastic deformations, the cleaning device 30 would have less deformation than the cleaning device of the conventional counter type. For this reason, it is obvious that the contact width in the cleaning device 30 according to the second embodiment is shorter than that in the cleaning device of the conventional counter type.

When using the blade 31 in the shape of a rectangular parallelepiped similarly to the second embodiment, the lengths T1, T2, and T3 of the edges of the rectangular parallelepiped are preferably configured to satisfy $T3>T1\geqq T2$. More preferably, T2 is not less than one millimeter, and not more than T1. If it is less than one millimeter, an unusual noise occurs more easily. If a pressure-relieving elastic material is used for the blade 31, or a material with a high degree in JIS A-hardness is selected, a wider preferable range of the lengths can be expected. The lengths of the blade 31 according to the second embodiment are as follows: T1 is 12 millimeters, T2 is 4 millimeters, and T3 is 325 millimeters; however, the lengths are not limited to this.

The blade 31 according to the second embodiment uses polyurethane rubber that has JIS A-hardness 75 degree, as a material. The material and hardness of the blade 31 are not limited to this, and can be appropriately changed. If a pressure-relieving elastic material, specifically, an elastic member having an impact resilience of 30% or less at 23° C. is used for the blade 31, stick-slip movement is reduced, so that the pressure-relieving elastic material is favorable. There are two reasons for the impact resilience to be 30% or less as described below. One is because less vibration of the blade 31 at the contact edge is better to clean spherical toner. Another is because low impact resilience is preferred for wear on the blade 31. Conventionally, when cleaning grinded toner, some blades have an effect that toner particles are hit away by touching the contact edge of a blade. Accordingly, there is a problem that the hitting-away effect does not work sufficiently at a low rate of impact resilience. However, when cleaning spherical toner particles, the particles go through the blade before the blade hits them, so that the hitting-away effect does not work. In a case where a blade has high impact resilience, if the contact edge of the blade easily vibrates to the photoconductor 10, the high impact resilience encourages spherical toner particles to go through the blade. On the other hand, the lower impact resilience is more advantageous for wear on the blade 31. On repeated image forming processes, a blade gradually wears out due to rubbing with a photoconductor. A mechanism of wear is considered that the stick-slip movement of the blade causes tear and fatigue breakdown on polymer molecules (for example, polyurethane rubber) forming the blade 31; as a result, wear occurs. In such case, part of the contact edge of the blade is cut, and toner particles go through there. By contrast, if the blade has an low impact resilience, the stick-slip movement of the blade is reduced. Accordingly, even after repeated operation processes, an accumulated number of times of vibration at the top edge of the blade is fewer than a high impact resilience blade, thus reducing fatigue breakdown. As a result, even after the image forming process is repeated, wear on the blade 31 does not advance, so that the cleaning performance is to be maintained for long time.

The blade holder 32 according to the second embodiment is made from a metal material mainly containing iron, which has a sufficient rigidity to suppress a warp satisfactorily, even if the blade 31 receives a force from the photoconductor 10 while the photoconductor 10 is rotating in operation.

In the second embodiment, the whole of the opposed surface of the upstream side surface 31*a* of the blade 31 is bonded to the horizontal portion 32A of the blade holder 32, as shown in FIG. 11. A bonding method other than the adhesive bonding employed in the second embodiment, such as bonding with double-faced adhesive tape, or hot melt, can be employed. Thus, according to the second embodiment, even if the photoconductor 10 is rotated while the blade 31 is pressed onto the surface of the photoconductor 10, a substantial warp in the blade 31 does not occurs.

Accordingly, robustness against environmental variation is improved. More specifically, in a configuration that a warp in a blade may occur, e.g., when a free length of the blade is long, a force caused by the warp in the blade changes depending on humidity. For example, if a warped blade is left as it is in a hot and humid environment, the blade is plastically deformed, and a permanent set occurs. In such case, the contact pressure of the blade onto the surface of the photoconductor 10 is decreased, and a cleaning performance is depreciated. Thus, there is a possibility that a cleaning failure may occur. By contrast, in the second embodiment where a substantial warp in the blade 31 hardly occurs, robustness against environmental variation is improved.

Occurrence of a warp in a blade means that the blade has a flexibility that allows the blade to warp. If the flexibility of the blade is large, in a case of the counter type, a blade turnup, which is a serious problem, easily occurs, when a friction force between the blade and the photoconductor surface increases. In the second embodiment where a substantial warp in the blade 31 hardly occurs, a blade turnup is prevented.

Furthermore, starting torque of the photoconductor 10 can be reduced. Specifically, as described above, if a blade warps, this means that the blade has a flexibility that allows the blade to warp. Due to a large friction force during the period of starting operation of the photoconductor, if the blade has a large flexibility, the blade is largely deformed in a moment, and torque is increased. By contrast, the blade 31 has substantially no warp according to the second embodiment, so that starting torque of the photoconductor 10 can be reduced.

According to the second embodiment, an end of the horizontal portion 32A facing the surface of the photoconductor 10, i.e., the end of the horizontal portion 32A coupled to the vertical portion 32B, is arranged at the same position as a border edge between the opposed surface (bonding surface) of the upstream side surface 31*a* and the downstream side surface 31*b*, as shown in FIG. 9. However, even if the end of the horizontal portion 32A is arranged to extend closer to the surface of the photoconductor 10 than the border edge of the blade 31, a substantial warp in the blade 31 hardly occurs, similarly to the first embodiment.

Alternatively, the end of the horizontal portion 32A does not need to be extended until the border edge of the blade 31. As long as a warp in the blade 31 can be virtually restricted, the end of the horizontal portion 32A does not need to reach the border edge. In other words, if a warp in the blade 31 is virtually restricted, the end of the horizontal portion 32A can be more distant from the photoconductor surface than the border edge. In such case, to what extent the end of the horizontal portion 32A can keep an additional distance from the photoconductor surface relative to the border edge is determined depending on hardness of the blade 31, a friction coefficient between the blade 31 and the surface of the photoconductor 10, and the like. An allowable range of the distance can be, e.g., as a guidepost for determination, a distance according to which a resultant length (contact width) of a contact point in the photoconductor-surface moving direction is to be not more than 50 micrometers, when pressing the blade 31 onto the surface of the photoconductor 10 to apply a linear pressure of 0.790 N/cm. It is estimated that up to a quarter of the length T2 of the downstream side surface 31*b* can be allowable as a distance between the end of the horizontal portion 32A and the border edge. Furthermore, there is a possibility that a range from a half of T2 up to the almost same level as T2 can be allowable.

Moreover, the blade 31 can be bonded to the horizontal portion 32A of the blade holder 32 by applying adhesive to only part of the bonding surface of the blade 31. However, it is desirable that bonding is performed at least on a marginal area close to the surface of the photoconductor 10 from across an overlapping area where the horizontal portion 32A and the opposed surface (bonding surface) of the upstream side surface 31*a* overlap one another. As the horizontal portion 32A of the blade holder 32 and the blade 31 are securely bonded in the end area, flapping of the blade 31 can be stably prevented, even if a friction force between the blade 31 and the photoconductor surface is changed for some reasons while the photoconductor is rotating in operation. This is the same to other bonding methods.

Thus, according to the second embodiment, when the blade 31 receives a force toward downstream in the photoconductor-surface moving direction, the whole of the blade 31 can be displaced away from the surface of the photoconductor 10. Accordingly, when the contact pressure is set to a relatively high level to obtain an excellent removal performance, even if a friction force between the blade 31 and the surface of the photoconductor 10 is increased during operation of the photoconductor 10, and the contact edge of the photoconductor 10 is displaced downstream in the photoconductor-surface moving direction, the blade 31 can escape away from the surface of the photoconductor 10. Thus, the maximum friction force arising from a change in the friction force between the blade 31 and the surface of the photoconductor 10 during operation of the photoconductor 10 is smaller than that in the conventional counter type. As a result, a frequency of giving an excessive operational load onto the photoconductor 10 is reduced.

Particularly, according to the second embodiment, the length of the blade 31 in the compression direction is shorter than that in the conventional counter type. Suppose the whole of the blade 31 were not configured capable to be displaced away from the surface of the photoconductor 10. When a large friction force occurs between the blade 31 and the surface of the photoconductor 10 during operation of the photoconductor 10 so that the blade receives a large force towards the shaft 34, a margin in which the blade 31 can be compressed and deformed by the received force is narrower than that in the conventional counter type. A contact pressure generated between the blade 31 and the surface of the photoconductor 10 would be higher than that in the conventional counter type, thereby causing a high frequency of giving an excessive operational load onto the photoconductor 10. For this reason, the configuration according to the second embodiment in which the whole of the blade can be displaced away from the surface of the photoconductor 10, and a resultant reduction in the frequency of giving an excessive operational load onto the photoconductor 10, are effective in the configuration that the length of the blade 31 in the compression direction is short.

Figure 13:
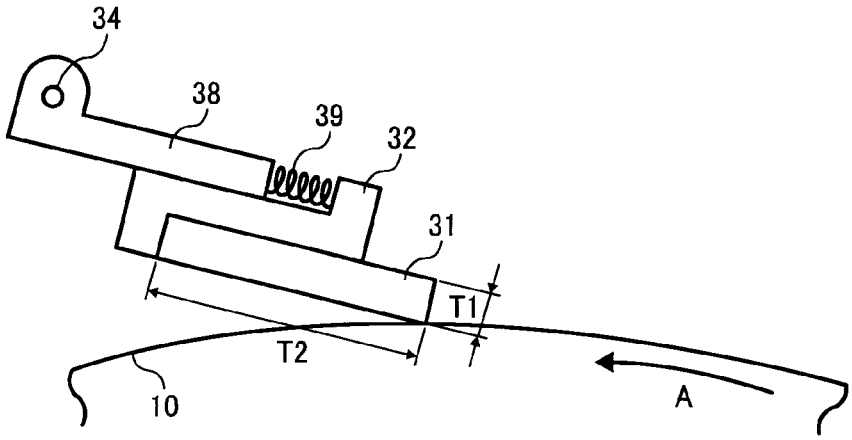
FIG. 13 is a schematic diagram for explaining another example of a blade to be provided in the cleaning device shown in FIG. 11.

The blade 31 can be arranged based on the configuration of the conventional counter type as shown in FIG. 13 in which the whole of the blade 31 can be displaced away from the surface of the photoconductor 10 when receiving a force towards downstream in the photoconductor-surface moving direction. In such configuration, the frequency of giving an excessive operational load onto the photoconductor 10 can be reduced, and an occurrence frequency of a blade turnup can be reduced. The blade 31 shown in FIG. 13 has the length T1 of two millimeters on the upstream side surface 31*a*, and the length T2 of 14 millimeters on the downstream side surface 31*b*, and 70 degrees of JIS A-hardness.

Figure 14:
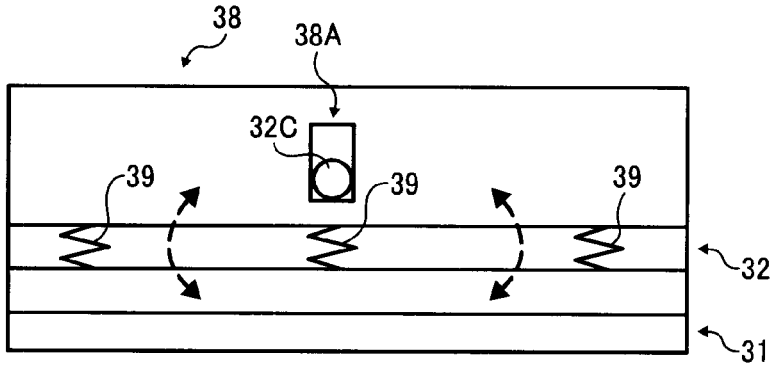
FIG. 14 is a schematic diagram for explaining a modification of the cleaning device shown in FIG. 11.

Alternatively, the blade 31 and the blade holder 32 can be configured in such a manner that the contact edge of the blade 31 can swing around a virtual axis tilted towards upstream of the normal line N in the photoconductor-surface moving direction, where the normal line N is normal to the contact point P on the surface of the photoconductor 10. Specifically, for example, as shown in FIG. 14, a rotation shaft 32C is provided on the vertical portion 32B of the blade holder 32, and a long hole 38A is provided on the blade bracket 38 for the rotation shaft 32C to be inserted, so that the contact edge of the blade 31 can swing around the rotation shaft 32C. Thus, even if the contact edge of the blade 31 is tilted due to a poor adhesion of the blade 31 to the blade holder 32, such tilt can be adjusted automatically. In such configuration, the compression spring 39 can be arranged at one position corresponding to the center of the blade 31 in the longitudinal direction, but also can be arranged at a plurality of points as shown in FIG. 14. Thus, the attitude of the blade 31 can be stably maintained. Moreover, such configuration can control displacement of the rotation shaft 32C with inner walls of the long hole 38A, thereby providing the same function as the displacement control unit described above.

The photoconductor 10 to be used in the printer according to the second embodiment is explained below.

To clean spherical toner, a larger load needs to be applied than that applied on the blade 31 when cleaning a conventional grinded toner. As a result, wear on the photoconductor 10 advances faster than in the conventional case, improvement in wear resistance of the photoconductor 10 is desired. An example of the photoconductor 10 used in the second embodiment is described below.

Figure 15:
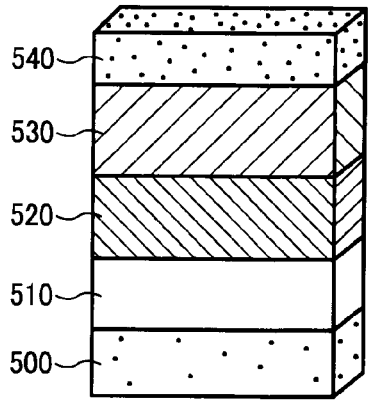
FIG. 15 is a side view of an example of a photoconductor to be used in the printer according to the second embodiment.

FIG. 15 is a side view of an example of the photoconductor 10 according to the second embodiment.

The photoconductor 10 used in the second embodiment is an organic photoconductor of negative charge, and includes an electroconductive base 500 that has the shape of drum of 30 millimeters in diameter, on which layers, such as a photosensitive layer, is provided. The electroconductive base 500 is a base layer, on which a base coating layer 510 that is an insulating layer is provided. On the base coating layer 510, a charge generation layer 520, and a charge transport layer 530 are provided. Furthermore, on the charge transport layer 530, a protective layer 540 for the surface is layered.

As the electroconductive base 500, a base made from a material showing electroconductivity of volume resistance $10^{10}$ Ω·cm or less can be used. For example, the following materials can be used: a film sheet or a cylinder of plastic or paper coated with a metal such as aluminum, nickel, chromium, nichrome, copper, gold, silver, platinum, or the like, or a metal oxide such as tin oxide, indium oxide, or the like, by evaporation or sputtering; a plate of aluminum, aluminum alloy, nickel, stainless, or the like; or a pipe obtained by forming a crude pipe from the plate by extruding or drawing followed by surface treatment such as cutting, super finishing, polishing or the like. An endless nickel belt and endless stainless belt disclosed in Japanese Patent Application Laid-Open No. S52-36016 can also be used for the electroconductive base 500.

In addition to this, a base coated with an electroconductive powder dispersed in an appropriate binder resin can also be used as the electroconductive base 500. Such electroconductive powders include carbon black, acetylene black, metal powder of aluminum, nickel, iron, nichrome, copper, zinc, silver, and the like, and metal oxide powder such as electroconductive tin oxide, indium tin oxide (ITO), and the like. The binder resins to be used with the electroconductive powder include thermoplastic, thermosetting resins, and photo-curing resins, such as polystyrene, styrene-acrylonitrile copolymer, styrene-butadiene copolymer, styrene-maleic anhydride copolymer, polyester, polyvinyl chloride, polyvinyl chloride-vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenolic resin, alkyd resin, and the like. Such electroconductive layer can be formed by applying a coating liquid in which an electroconductive powder and a binder resin are dispersed in an appropriate solvent, such as tetrahydrofuran, dichloromethane, methyl ethyl ketone, toluene, or the like. Furthermore, an appropriate cylindrical base on which an electroconductive layer is formed using a thermally contractive tube made from a material, such as polyvinyl chloride, polypropylene, polyester, polystyrene, polyvinylidene chloride, polyethylene, chlorinated rubber, TEFLON (registered trademark), or the like, added with the electroconductive powder, can also be favorably used as the electroconductive base 500.

The photosensitive layer is explained below.

The photosensitive layer can be either a single layer, or a laminated layer. For convenience of explanation, a case of a laminated-layer configuration including a charge generation layer and a charge transport layer is explained below at first.

The charge generation layer 520 includes a charge generation material as a main component. Known charge generation materials can be used for the charge generation layer 520. Typical materials include monoazo pigment, bisazo pigment, trisazo pigment, perylene pigment, perinone pigment, quinacridone pigment, quinone polycondensed compound, squaric acid dyes, other phthalocyanine pigments, naphthalocyanine pigment, and azulenenium dyes. The charge generation materials can be used alone or in combination.

The charge generation substance(s), together with a binder resin as required, are dispersed in an appropriate solvent by using a ball mill, an attritor, a sand mill, or ultrasonic wave, the obtained product is applied on the electroconductive base 500 or the base coating layer 510, and then dried, so that the charge generation layer 520 is formed.

For the charge generation layer 520, the charge generation materials can be dispersed in a binder resin as required. Suitable binder resins, which can be included in the charge generation layer 520, include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzene, polyester, phenoxy resin, polyvinyl-chloride/acetate copolymer, polyvinyl acetate, polyphenylene oxide, polyvinyl pyridine, cellulose resin, casein, polyvinyl alcohol, and polyvinyl pyrrolidone. An appropriate amount of the binder resin is between 0 wt. part and 500 wt. parts per 100 wt. parts of the charge generation material, preferably between 10 wt. parts and 300 wt. parts. Addition of the binder resin can be either before or after dispersion. As a solvent to be used here, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, or ligroin can be used. Particularly, a ketone solvent, an ester solvent, or an ether solvent is preferably used. The solvents can be used alone or in combination.

The charge generation layer 520 include a charge generation material, a solvent, and a binder resin, as main components, each of which can contain any additive, such as sensitizers, dispersants, surfactants and silicone oils.

As a coating method for an application liquid, dip coating, spray coating, bead coating, nozzle coating, spinner coating, ring coating, or the like, can be used. The appropriate thickness of the charge generation layer 520 is approximately between 0.01 micrometer and 5 micrometers, preferably between 0.1 micrometer and 2 micrometers.

The charge transport layer 530 can be formed by dissolving or dispersing a charge transport material and a binder resin in an appropriate solvent, applying the resultant solution on the charge generation layer 520, and drying. In addition to this, one or more of a plasticizer, a leveling agent, an antioxidant, and the like, can be added.

The charge transport materials include positive hole transport materials and electron transport materials. The electron transport materials include electron accepting materials, such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2,-b]thiophene-4-on, 1,3,7-trinitrodibenzothiophene-5,5-dioxide, benzoquinone derivative, and the like.

The positive hole transport materials include poly-N-vinylcarbazole and derivatives thereof, poly-γ-carbazolylethyl glutamate and derivatives thereof, pyrene-formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These charge transport materials can be used alone or in combination of two or more.

The binder resins include thermoplastic and thermosetting resins, such as polystyrene, styrene-acrylonitrile copolymer, styrene-butadiene copolymer, styrene-maleic anhydride copolymer, polyester, polyvinyl chloride, polyvinyl chloride-vinyl acetate copolymer, polyvinyl acetate, polyvinlydene chloride, polyarate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, alkyd resin, and the like.

The appropriate amount of the charge transport material is between 20 wt. parts and 300 wt. parts per 100 wt. parts of the binder resin, preferably between 40 wt. parts and 150 wt. parts. The thickness of the charge transport layer 530 is preferably less than or equal to 25 micrometers, in light of resolutions and responsiveness. The lower limit of the thickness is preferably more than or equal to five micrometers, although it depends on a system to be used (particularly, depending on charge potential). The solvents used herein include tetrahydrofurane, dioxane, toluene, dichloromethane, monochlorobenzene, dichloroethane, cyclohexane, methyl ethyl ketone, acetone, and the like. The solvents can be used alone or in combination of two or more.

A case of the photosensitive layer has a single-layer configuration is explained below.

The photosensitive layer is formed by dissolving or dispersing the charge generation material, the charge transport material, and the binder resin into an appropriate solvent, and applying the resultant solution on the electroconductive base 500 or the base coating layer 510, and then drying. The photosensitive layer can be formed only from the charge generation material and the binder resin, without containing the charge transport material. Furthermore, a plasticizer, a leveling agent, an antioxidant, and the like, can be added as required.

In addition to the binder resins listed in the description of the charge transport layer 530, the binder resins listed in the description of the charge generation layer 520 can be used by mixing. The high-molecular charge transport materials described above can also be used. The amount of the charge generation material per 100 wt. parts of the binder resin is preferably between 5 wt. parts and 40 wt. parts, and the amount of the charge transport material is preferably between 0 part and 190 wt. parts, more preferably between 50 wt. parts and 150 wt. parts.

The photosensitive layer can be formed by applying a coating solution that the charge generation material, the binder resin, and the charge transport material are dispersed by a dispersing machine into a solvent, such as tetrahydrofuran, dioxane, dichloroethane, cyclohexane, or the like, by dipping coating, spray coating, bead coating, ring coating, or the like. The appropriate thickness of the photosensitive layer is between 5 micrometers and 25 micrometers.

On the photoconductor 10 according to the second embodiment, the base coating layer 510 can be provided between the electroconductive base 500 and the photosensitive layer. Generally, a base coating layer includes a resin as a main component. The resin desirably has high resistance to general organic solvents, in light of use of a solvent for applying the photoconductive layer onto the resin. Such resins include a water-soluble resin, such as polyvinyl alcohol, casein, and sodium polyacrylate; an alcohol-soluble resin, such as copolymerized nylon and methoxy methylated nylon; a thermosetting resin forming a three-dimensional network structure, such as polyurethane, melamine resin, phenolic resin, alkyd-melamine resin, and epoxy resin. In addition, a fine powdery pigment of a metal oxide, such as titanium oxide, silica, alumina, zirconium oxide, tin oxide, or indium oxide, can be added to the base coating layer 510 for prevention of moire, reduction of residual potential, and the like. The base coating layer 510 can be formed using a suitable solvent and an appropriate coating method similarly to the photosensitive layer described above. As the base coating layer 510, a silane coupling agent, a titanium coupling agent, a chromium coupling agent, or the like, can be used. Moreover, for the base coating layer 510, a substance having $Al_2O_3$ provided by anodic oxidation, or a substance having organics, such as polypropylenes (parylene), or inorganics such as $SiO_2$, $SnO_2$, $TiO_2$, ITO, $CeO_2$, and the like, provided by a vacuum thin film forming method, can also be favorably used. Other known substances can also be used as well as the above.

The appropriate thickness of the base coating layer 510 is between 0 micrometer and 5 micrometers.

To prevent wear on mechanics, the protective layer 540 can be provided on the top layer of the photoconductor 10. For example, a photoconductor surface-coated with amorphous silicon to enhance wear resistance, or an organic photoconductor on which a top surface layer containing dispersed alumina or tin is provided further over the charge transport layer 530.

The configuration of the photoconductor 10 that can be used in the embodiments is not limited to a particular configuration. The embodiments according to the present invention can be applied to photoconductors having various layer-configurations: a single-layer configuration in which only a photosensitive layer mainly including a charge generation material and a charge transport material is provided on an electroconductive base; a configuration in which a charge generation layer mainly including a charge generation material and a charge transport layer mainly including a charge transport material are layered on the electroconductive base; a configuration in which a photosensitive layer mainly including a charge generation material and a charge transport material is provided on the electroconductive base, and a protective layer is further provided on the photosensitive layer; a configuration in which a charge generation layer mainly including a charge generation material and a charge transport layer mainly including a charge transport material are layered on the electroconductive base, and a protective layer is further provided on the charge transport layer; and a configuration in which a charge transport layer mainly including a charge transport material and a charge generation layer mainly including a charge generation material are layered on the electroconductive base, and a protective layer is further provided on the charge generation layer.

As a binder configuration of the protective layer, a protective layer having a crosslinked structure is effectively used. To form a crosslinked structure, using a reactive monomer that has a plurality of crosslinked functional groups within a molecule, a crosslinking reaction is generated with light and heat energy, and a three-dimensional network structure is to be formed. The network structure functions as the binder resin, and realizes excellent wear resistance. In light of electrical stability, printing endurance, and life duration, an entire or partial use of a monomer having a charge transport force as the reactive monomer is effective. By using such monomer, a charge transport area is formed in the network structure, so that functions as the protective layer can be expressed sufficiently. Reactive monomers having the charge transport force include a compound that contains at least one each of charge transportable components and atoms of silicon having a hydrolytic substituent within a molecule, a compound that contains a charge transportable component and a hydroxyl group within a molecule, a compound that contains a charge transportable component and a carboxyl group within a molecule, a compound that contains a charge transportable component and an epoxy group within a molecule, a compound that contains a charge transportable component and an isocyanate group within a molecule, and the like. Charge transportable materials having the reactive groups can be used alone or in combination of two or more. More preferably, a reactive monomer having a triarylamine structure is effectively used, because the triarylamine structure has a high electrical stability and a high chemical stability as a monomer having a charge transport force, and the carrier has a high mobility. In addition, for the purpose of giving functions, such as viscosity control during application process, stress relaxation of a crosslinkage charge transport layer, lowering surface energy, and friction coefficient reduction, monofunctional and difunctional polymerization monomer and polymerization can be used in conjunction with the other materials. Known polymerization monomers or oligomers can be used. According to the embodiments of the present invention, polymerization or crosslinkage of a positive hole transport compound is performed thermally or by photoirradiation. When thermally polymerizing, in a case, polymerization is advanced only with thermal energy, by contrast, a polymerization initiator is required for polymerization in the other case. To advance the reaction at a lower temperature more efficiently, the use of a polymerization initiator is preferred. When photopolymerizing, ultraviolet rays are preferably used. However, polymerization is hardly advanced only with light energy, so that a photopolymerization initiator is generally used in conjunction with the other materials. In such case, the polymerization initiator mainly absorbs ultraviolet rays less than or equal to 400 nanometers, generates activated species, such as free radical or ion, and starts polymerization. Heat and the photopolymerization initiator can be used together. The charge transport layer having the network structure in this way has an excellent wear resistance, on the other hand, has large volume shrinkage during crosslinking reaction, so that an excessively thick coating may cause a crack. In such case, the protective layer can a layered structure, a protective layer made from a low-molecular-weight dispersion polymer is used for a lower layer (photosensitive layer side), and a protective layer having a crosslinked structure can be formed on an upper layer (surface side).

For an example of the photoconductor 10, 182 wt. parts of methyltrimethoxysilane, 40 wt. parts of dihydroxymethyl triphenylamine, 225 wt. parts of 2-propanol, 106 wt. parts of 2% acetic acid, and 1 part of aluminum trisacetylacetonate are mixed, and then a coating liquid for protection is prepared. The coating liquid is applied on a charge transport layer, and dried. The resultant layer is then thermoset at 110° C. for an hour, so that a protective layer having a thickness of 3 micrometers is formed.

Another example of the protective layer is as follows. A surface protective layer coating liquid is prepared by dissolving 30 wt. parts of positive hole transport material, and 0.6 wt. parts of an acrylic monomer and a photopolymerization (1-hydroxy-cyclohexyl-phenyl-ketone), into a mix solvent of 50 wt. parts of monochlorobenzene and 50 wt. parts of dichloromethane. The coating liquid was applied on the charge transport layer by a spray coating method. The coated layer is then cured by being exposed to light emitted by a metal halide lamp with the intensity of 500 mW/cm$^2$ for 30 seconds. As a result, a surface protective layer of five micrometers in thickness is prepared.

The electric charger 40 to be used in the printer according to the second embodiment is explained below.

Conventionally, there is an electric charger by the corona charging method of charging up with corona discharge. According to the corona charging method, a charging wire is arranged in the vicinity of a charge target; corona discharge is generated between the charging wire and the charge target by applying a high voltage to the charging wire; and then the charge target is charged. However, in a case of the corona charging method, some discharge by-products, such as ozone and nitrogen oxide are produced along with the corona discharge. Because the discharge by-products may form a coat of nitric acid or nitrate, its production should be avoided, if possible. Recently, instead of the corona charging method, developments of a contact electrification method and a proximity electrification method are actively proceeding, which cause less discharge by-products and can perform electrification with low force. By the methods, a charging member, such as a roller, a brush, or a blade, is placed to face a charge target in contact or in proximity, and applied with a voltage, so that the surface of a charge target is charged. According to the methods, less discharge by-products and electrification with low force than the corona charging method can be achieved, thus making the methods be effective. Moreover, the methods do not require large charging equipment, so that a device can be reduced in size, which satisfies a need for miniaturization of equipment. For this reason, in the second embodiment, an example of the electric charger 40 using a non-contact roller charging method is described below, as an example of an electric charger that achieves reduction in power consumption, reduction in hazardous substances, and the need for miniaturization.

When using spherical toner, a cleaning failure tends to occur often than when using conventional grinded toner. Even if the cleaning failure occurs by any chance due to the configuration capable of blade cleaning of spherical toner, the non-contact roller charging method does not allow the electric charger to reach residual toner caused by the cleaning failure, so that there is an advantage that no erroneous image caused by irregular charge is created. The electric charger 40 charges a photoconductor by alternating-current application discharge using the charging roller 41, which is a charging member arranged not in contact with but in proximity to the photoconductor.

Alternatively, there is another method according to which a photoconductor is charged by the alternating-current application discharged with a charging member arranged in contact with the photoconductor. If using the method, it is preferable that contact between the photoconductor surface and the charging member is to be improved, and an elastic member that does not apply any mechanical stress onto the photoconductor is to be used. However, if using the elastic member, a charging nip width is widened, consequently a charging roller may turns to deposit a protective material more easily. Therefore, to apply a greater durability to a charge target, a non-contact charging method is more advantageous.

Figure 16:
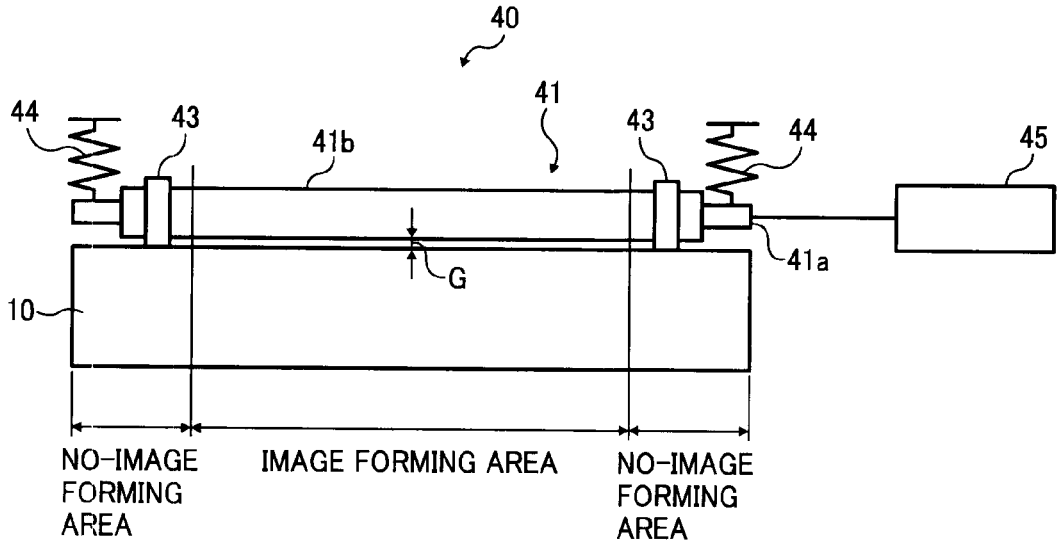
FIG. 16 is a schematic diagram for explaining a charging device, viewed from the direction orthogonal to the photoconductor rotation-axis direction, to be used in the printer according to the second embodiment.

FIG. 16 is a schematic diagram for explaining the electric charger 40 according to the second embodiment, viewed from the direction orthogonal to the rotation-axis direction of the photoconductor 10.

The electric charger 40 includes the charging roller 41, spacers 43, springs 44, and a power source 45. The charging roller 41 includes a shaft 41*a* and a roller 41*b*. The roller 41*b* is opposed to the photoconductor 10, and responsible for charging the photoconductor surface, and configured to rotate by rotation of the shaft 41*a*. The spacers 43 are space keeping members. To arrange a charge area on the surface of the roller 41*b* on the opposite side of the photoconductor surface with very small gap, the spacers 43 are provided on the charging roller 41. From across the surface of the photoconductor 10, an area facing an image forming area in which an image is to be formed is arranged not in contact with the photoconductor 10 by the spacers 43. The longitudinal dimension (in the photoconductor rotation-axis direction) of the roller 41*b* is set longer than that of the image forming area on the photoconductor 10. The spacers 43 are set in contact with no-image forming areas on the photoconductor 10, so that a very small gap G is formed. The charging roller 41 is configured to rotate in conjunction with the photoconductor surface via the spacer 43. The very small gap G is configured in such a manner that a distance at the closest point between the roller 41*b* and the photoconductor 10 is to be between 1 micrometer and 100 micrometers. More preferably, the closest distance is between 30 micrometers and 65 micrometers. In the second embodiment, the very small gap G is set to 50 micrometers.

The springs 44 are mounted on the shaft 41*a* for pressing the charging roller 41 towards the surface of the photoconductor 10. The springs 44 ensures the electric charger 40 to maintain the very small gap G precisely. The charging roller 41 is connected to the power source 45, and uniformly charges the surface of the photoconductor 10 by the alternating-current application discharge in the very small gap G. According to the second embodiment, an alternating voltage that a volt alternating current of an alternating current component is superposed on a volt direct current of a direct current component is applied to the roller 41*b* of the charging roller 41. By using the alternating voltage, influences, such as variations in charged potential due to instability of the very small gap G, are suppressed, so that the photoconductor surface can be uniformly charged.

The charging roller 41 includes a cored bar as an electroconductive base in a cylindrical shape, and a resistance control layer formed on a circumferential surface of the cored bar. In the second embodiment, the diameter of the charging roller 41 is 10 millimeters. The surface of the charging roller 41 can be made from a known material, such as a rubber member, more preferably, a resin material. The reason for this is because a rubber member may absorb water, and deflect or warp, so that it turns difficult to maintain the very small gap G. Depending on an image forming condition, there is a possibility that only the central part of the charging roller 41 suddenly contacts the photoconductor surface. It is difficult to cope with irregularity in the photoconductor surface layer caused by such local and sudden contact of the charging roller 41 with the photoconductor 10. If charging the photoconductor by the non-contact charging method, more preferably a rigid material is used in such a manner that the very small gap G can be maintained uniform between the charging roller 41 and the photoconductor 10.

For forming the surface layer of the charging roller 41 from a rigid material, e.g., the following materials can be used. The resistance control layer is formed from thermo plastic resin constitutions, such as polyethylene, polypropylene, methyl polymethacrylate, polystyrene, and copolymer thereof, and the surface of the resistance control layer is hardened with a hardening agent. Coating hardening can be performed by dipping the resistance control layer in a treatment solution containing an isocyanate compound. Alternatively, another hardening coat layer can be additionally formed on the surface of the resistance control layer.

Details of toner to be used in the printer according to the second embodiment are the same as described above, so that explanation for it is omitted.

As described above, the cleaning device 30 according to the second embodiment can reduce the frequency of occurrence of blade turnup and the frequency of giving an excessive load onto operation of the photoconductor 10, even when a high contact pressure is set to obtain an excellent removal performance.

Particularly, to apply the blade 31 an elastic force towards the opposite direction to the direction away from the surface of the photoconductor 10, units that apply such elastic force generated by spring is used, that is the compression springs 39, thereby achieving a simple configuration.

As shown in FIG. 14, if the contact edge of the blade 31 is tilted with respect to the photoconductor rotation-axis direction, the tilt can be automatically adjusted, because the contact edge of the blade 31 can swing around the rotation shaft 32C.

In this case, the elastic force applied by the compression springs 39 has a force component in the direction of pressing the blade 31 onto the surface of the photoconductor 10 towards upstream in the photoconductor-surface moving direction. As the compression springs 39 apply the elastic force individually to a plurality of points different each other along the longitudinal direction of the blade 31, the attitude of the blade 31 can be stably maintained.

In the period of starting operation of the photoconductor 10, during which the contact pressure between the blade 31 and the photoconductor 10 tends to increase excessively, the contact pressure can be released, and excessive increase in the contact pressure can be suppressed.

The contact angle θ of the blade 31 can be prevented from widening beyond a predetermined range. As a result, the regular contact pressure is prevented from being increased, thereby avoiding heavy wear on the surface of the photoconductor 10, and increase in the regular operational load onto the photoconductor 10.

The cleaning device 30 can achieve a sufficiently high contact pressure.

If the friction force is suddenly increased unexpectedly, the contact edge of the blade 31 can return to the contact point P.

In the cleaning device 30, wear on the blade 31 is suppressed.

The cleaning device 30 can make the contact width short, while maintaining the contact pressure as high as that in the cleaning device of the conventional counter type, thereby achieving a high contact pressure.

The blade 31 in the cleaning device 30 has no free length part, so that warp in the blade 31 can be effectively restricted.

In the second embodiment, a lubricant applying unit that feeds a lubricant onto the surface of the photoconductor 10 can be provided.

Although the cleaning device 30 for a photoconductor is explained above in the second embodiment, the second embodiment can be applied to a cleaning device for a surface moving member in any image forming apparatus, as well as the printer 100 according to the second embodiment. For example, the second embodiment can be applied to a monochrome image forming apparatus, and an image forming apparatus that includes a photoconductor and a plurality of developing devices (e.g., for four colors), toner images of the respective colors are produced by rotating the developing devices, and then an image is formed finally by transferring the toner images onto transfer paper. Not only for a printer, the second embodiment can be used as a cleaning device for a photocopier, a facsimile, or a multifunctional peripheral having a plurality of functions. Regardless of an electrophotographic type, an ink jet type, or another type, as long as an image forming apparatus includes a surface moving member and requires to remove deposit remaining on the surface of the surface moving member, the second embodiment can be applied to the image forming apparatus. Deposit to be removed can be toner, paper powder, metal powder, and any other powdery substance, and even a liquid, such as a developer, so that the second embodiment can be similarly applied.

In addition to the cleaning device for the photoconductor, the second embodiment can be applied to a cleaning device for removing deposit, such as residual toner, remaining on the surface on a surface moving member other than the photoconductor, e.g., the intermediate transfer belt 162. Moreover, the second embodiment can be applied to a cleaning device for removing deposit, such as toner or paper powder, attached on a recording material conveyor member that supports and conveys a recording material on its surface. The second embodiment can be applied to a cleaning device for any surface moving member that requires to remove deposit attached on its surface. The surface moving member can be a drum, a belt, or in any other shape, of which member surface moves. When the cleaning device is used for the surface moving member of a belt, the cleaning device is generally arranged to catch the belt between the blade and a supporting roller that supports the belt. However, a backup member, such as a flat plate member, can be arranged on the internal side of the belt, and the cleaning device can be arranged to catch the belt between the blade and the backup member. When a target to be cleaned is the photoconductor 10, the cleaning device according to the second embodiment can be applied for any photoconductor, which can be an organic photoconductor, an amorphous silicon photoconductor, or a photoconductor of which a protective layer made from a binder resin having a crosslinked structure is provided on an organic photoconductor surface. When a target to be cleaned is the intermediate transfer belt 162, the cleaning device according to the second embodiment can be applied for any intermediate transfer belt, which can be an intermediate transfer belt made form polyimides considering heat resistance and strechability, an intermediate transfer belt using polyethylene materials, or an intermediate transfer belt made of fluoric materials and rubber materials.

In the various applications explained above, the configuration of the cleaning device 30 for a photoconductor explained in the second embodiment can be used without substantial change, or a configuration that is appropriately modified in accordance with each of the application can be used.

According to the embodiments of the present invention, a contact pressure higher than or equivalent to that in the cleaning device of the conventional counter type can be obtained, thereby achieving an excellent removal performance. On the other hand, a contact width can be made shorter than that in the cleaning device of the conventional counter type, wear on the surface moving member and the elastic member can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device that removes deposit on a surface of a surface moving member that rotates in a surface moving direction, the cleaning device comprising:

a cleaning blade made of an elastic member elongated along a rotation axis of the surface moving member, the cleaning blade including a longitudinal edge formed along its elongated direction, the longitudinal edge being pressed against the surface of the surface moving member at a contact point in a counteracting direction that intersects the surface moving direction, thereby removing the deposit from the surface of the surface moving member, a first surface that is positioned at a downstream of the contact point in the surface moving direction with respect to a normal line to the surface of the surface moving member at the contact point, the first surface making a predetermined angle with a tangent line to the surface moving member at the contact point, a second surface that is positioned at an upstream of the contact point in the surface moving direction with respect to the normal line, the second surface adjoining with the first surface to form the longitudinal edge, and a third surface that is positioned on an opposite side of the second surface, adjoining with the first surface at the downstream of the contact point;

a warp restrictive member that is attached on the third surface, the warp restrictive member restricting a warp in the cleaning blade, the warp being formed in a manner that the second surface expands and the third surface shrinks; and a holding member that is supported by a main body of the cleaning device at the downstream of the contact point, the holding member holding the cleaning blade via the warp restrictive member, wherein a thickness of the cleaning blade in a direction of the normal line is thicker than a thickness of the cleaning blade in the surface moving direction.

2. The cleaning device according to claim 1, wherein lengths of the second surface and the third surface in the direction of the normal line is longer than a length of the first surface in the surface moving direction.

3. The cleaning device according to claim 2, wherein the first surface and the second surface make an obtuse angle.

4. The cleaning device according to claim 3, wherein the second surface includes a fourth surface and a fifth surface adjoining with each other, the fourth surface being a part of the second surface, the fifth surface adjoining with the first surface making the obtuse angle therebetween.

5. The cleaning device according to claim 1, wherein an end portion of the warp restrictive member in a vicinity of the surface of the surface moving member extends to either one of a border edge between the first surface and the third surface and a position closer to the surface of the surface moving member than the border edge.

6. The cleaning device according to claim 5, wherein the warp restrictive member is mounted over an entire area of the third surface.

7. The cleaning device according to claim 1, wherein, from across an area in which the warp restrictive member and the third surface overlap one another, at least a marginal area close to the surface of the surface moving member is bonded.

8. The cleaning device according to claim 1, further comprising a force assistance unit that enhances a force to press the longitudinal edge against the surface of the surface moving member in a direction of the normal line.

9. The cleaning device according to claim 8, wherein the predetermined angle is equal to or larger than 5degrees and equal to or smaller than 50 degrees when the cleaning blade is not pressed against the surface of the surface moving member.

10. An image forming apparatus that transfers an image formed on an image bearing member that is a surface moving member finally onto a recording material, the image forming apparatus comprising:

a cleaning unit that removes unwanted deposit on the image bearing member, wherein the cleaning unit is the cleaning device according to claim 1.

11. The image forming apparatus according to claim 10, further comprising a process cartridge that integrally supports the image bearing member and the cleaning device, and configured to be provided in the image forming apparatus in a demountable manner.

12. The image forming apparatus according to claim 10, wherein, as a toner to form an image, the image forming apparatus uses a toner that satisfies any one of conditions that a volume average particle diameter is between three micrometers and seven micrometers, that an average circularity is between 0.940 and 0.998, and that each of a first shape factor indicative of a degree of roundness of a toner shape and a second shape factor indicative of the degree of the concavity and convexity of a toner shape is between 100 and 160.

13. The image forming apparatus according to claim 10, wherein, as a toner to form an image, the image forming apparatus uses a toner obtained by dissolving and dispersing toner constitutions including a polyester prepolymer having a functional group containing a nitrogen atom, polyester, a colorant, and a release agent into an organic solvent, thereby preparing an organic solvent constitution, and dispersing the organic solvent constitution into an aqueous medium containing resin microparticles, thereby performing at least one of crosslinkage and elongation.

14. A process cartridge configured to be included in a demountable manner in an image forming apparatus that transfers an image formed on an image bearing member, which is a surface moving member, finally onto a recording material, the process cartridge integrally supporting the image bearing member and a cleaning unit that removes unwanted deposit attached on the image bearing member, the process cartridge comprising:

a cleaning unit that removes unwanted deposit attached on the image bearing member, wherein the cleaning unit is the cleaning device according to claim 1.

15. The cleaning device according to claim 1, wherein the warp restrictive member and the holding member are integrally formed.

* * * * *